US010378749B2

(12) United States Patent
Progl

(10) Patent No.: US 10,378,749 B2
(45) Date of Patent: Aug. 13, 2019

(54) LIGHTING DEVICE COMPRISING SHIELD ELEMENT, AND SHIELD ELEMENT

(71) Applicant: CREE, INC., Durham, NC (US)

(72) Inventor: Curt Progl, Raleigh, NC (US)

(73) Assignee: IDEAL Industries Lighting LLC, Sycamore, IL (US)

( * ) Notice: Subject to any disclaimer, the term of this patent is extended or adjusted under 35 U.S.C. 154(b) by 305 days.

(21) Appl. No.: 13/622,763

(22) Filed: Sep. 19, 2012

(65) Prior Publication Data

US 2013/0208469 A1 Aug. 15, 2013

Related U.S. Application Data

(60) Provisional application No. 61/597,481, filed on Feb. 10, 2012.

(51) Int. Cl.

| | |
|---|---|
| ***F21V 29/00*** | (2015.01) |
| ***F21V 29/506*** | (2015.01) |
| *F21V 29/83* | (2015.01) |
| *F21K 9/232* | (2016.01) |
| *F21Y 115/10* | (2016.01) |

(52) U.S. Cl.

CPC ..... *F21V 29/506* (2015.01); *F21K 9/232* (2016.08); *F21V 29/83* (2015.01); *F21Y 2115/10* (2016.08)

(58) Field of Classification Search

CPC ..... F21Y 2101/02; F21Y 2103/003; F21V 29/20; F21V 29/02; F21V 3/02; F21V 15/01; F21V 29/002; F21V 29/004

USPC ..... 362/186, 218, 217.14–217.16

See application file for complete search history.

(56) References Cited

U.S. PATENT DOCUMENTS

| | | | |
|---|---|---|---|
| 3,755,697 | A | 8/1973 | Miller |
| 3,787,752 | A | 1/1974 | Delay |
| 4,090,189 | A | 5/1978 | Fisler |
| 4,211,955 | A | 7/1980 | Ray |
| 4,717,868 | A | 1/1988 | Peterson |
| 4,918,487 | A | 4/1990 | Coulter, Jr. |
| 5,087,212 | A | 2/1992 | Hanami |
| 5,151,679 | A | 9/1992 | Dimmick |
| 5,175,528 | A | 12/1992 | Choi et al. |

(Continued)

FOREIGN PATENT DOCUMENTS

| | | |
|---|---|---|
| DE | 10 2007 040 444 | 3/2009 |
| JP | 2004-265626 | 9/2004 |

(Continued)

OTHER PUBLICATIONS

U.S. Appl. No. 12/411,905, filed Mar. 26, 2009, Van de Ven.

(Continued)

*Primary Examiner* — Gerald J Sufleta, II

(74) *Attorney, Agent, or Firm* — Burr & Brown, PLLC

(57) ABSTRACT

A lighting device, comprising a shield element and at least a first light source, the first light source within a space defined by portions of the shield element, the shield element comprising at least one vent, the shield element blocking the first light source from direct view from locations outside the shield element. Also, a lighting device, comprising a shield element and at least a first light source, the shield element comprising regions that define an opening, the first light source within a space defined by portions of the shield element and the opening. Also, a shield element.

27 Claims, 5 Drawing Sheets

(56) References Cited

U.S. PATENT DOCUMENTS

| | | | |
|---|---|---|---|
| 5,345,167 | A | 9/1994 | Hasegawa et al. |
| 5,378,158 | A | 1/1995 | Owen et al. |
| 5,585,688 | A | 12/1996 | DeKleine |
| 5,631,190 | A | 5/1997 | Negley |
| 5,661,645 | A | 8/1997 | Hochstein |
| 5,736,881 | A | 4/1998 | Ortiz |
| 5,844,377 | A | 12/1998 | Anderson et al. |
| 5,850,126 | A | 12/1998 | Kanbar |
| 5,912,477 | A | 6/1999 | Negley |
| 5,912,568 | A | 6/1999 | Kiley |
| 5,946,931 | A | 9/1999 | Lomax et al. |
| 6,150,771 | A | 11/2000 | Perry |
| 6,161,910 | A | 12/2000 | Reisenauer et al. |
| 6,222,172 | B1 | 4/2001 | Possum et al. |
| 6,285,139 | B1 | 9/2001 | Ghanem |
| 6,329,760 | B1 | 12/2001 | Bebenroth |
| 6,340,868 | B1 | 1/2002 | Lys et al. |
| 6,353,295 | B1 | 3/2002 | Sridhar et al. |
| 6,362,578 | B1 | 3/2002 | Swanson et al. |
| 6,388,393 | B1 | 5/2002 | Illingworth |
| 6,400,101 | B1 | 6/2002 | Biebl et al. |
| 6,528,954 | B1 | 3/2003 | Lys et al. |
| 6,573,536 | B1 | 6/2003 | Dry |
| 6,577,072 | B2 | 6/2003 | Saito et al. |
| 6,586,890 | B2 | 7/2003 | Min et al. |
| 6,598,996 | B1 | 7/2003 | Lodhie |
| 6,614,358 | B1 | 9/2003 | Hutchison et al. |
| 6,636,003 | B2 | 10/2003 | Rahm et al. |
| 6,724,376 | B2 | 4/2004 | Sakura et al. |
| 6,747,420 | B2 | 6/2004 | Barth et al. |
| 6,808,287 | B2 | 10/2004 | Lebens et al. |
| 6,815,724 | B2 | 11/2004 | Dry |
| 6,836,081 | B2 | 12/2004 | Swanson et al. |
| 6,841,947 | B2 | 1/2005 | Berg-johansen |
| 6,873,203 | B1 | 3/2005 | Latham, II et al. |
| 6,948,829 | B2 | 9/2005 | Verdes et al. |
| 6,987,787 | B1 | 1/2006 | Mick |
| 6,995,518 | B2 | 2/2006 | Havlik et al. |
| 7,031,155 | B2 | 4/2006 | Sauciuc et al. |
| 7,038,399 | B2 | 5/2006 | Lys et al. |
| 7,064,498 | B2 | 6/2006 | Dowling et al. |
| 7,071,762 | B2 | 7/2006 | Xu et al. |
| 7,119,498 | B2 | 10/2006 | Baldwin et al. |
| 7,144,135 | B2 | 12/2006 | Martin et al. |
| 7,172,314 | B2 | 2/2007 | Currie et al. |
| 7,180,487 | B2 | 2/2007 | Karnikawa et al. |
| 7,202,608 | B2 | 4/2007 | Robinson et al. |
| 7,213,940 | B1 | 5/2007 | Van De Ven et al. |
| 7,245,495 | B2 | 7/2007 | Ouyang |
| 7,253,446 | B2 | 8/2007 | Sakuma et al. |
| 7,396,142 | B2 | 7/2008 | Laizure, Jr. et al. |
| 7,434,964 | B1 | 10/2008 | Zheng et al. |
| 7,521,875 | B2 | 4/2009 | Maxik |
| 7,524,089 | B2 | 4/2009 | Park |
| 7,534,015 | B2 | 5/2009 | Xu et al. |
| 7,556,869 | B2 | 7/2009 | Fukushima et al. |
| 7,611,263 | B2 | 11/2009 | Huang et al. |
| 7,661,854 | B1 | 2/2010 | Yang et al. |
| 7,744,250 | B2 | 6/2010 | Lee et al. |
| D626,267 | S | 10/2010 | Pickard |
| D644,356 | S | 8/2011 | Pickard |
| 8,066,414 | B2 | 11/2011 | Pabst et al. |
| 8,104,919 | B2 | 1/2012 | Wung et al. |
| 2003/0063462 | A1 | 4/2003 | Shimizu et al. |
| 2003/0117803 | A1 | 6/2003 | Chen |
| 2005/0111234 | A1 | 5/2005 | Martin et al. |
| 2005/0200289 | A1 | 9/2005 | Krichtafovitch |
| 2006/0056113 | A1 | 3/2006 | Fukushima et al. |
| 2007/0102033 | A1 | 5/2007 | Petrocy |
| 2007/0230184 | A1 | 10/2007 | Shuy |
| 2008/0055909 | A1 | 3/2008 | Li |
| 2008/0316755 | A1 | 12/2008 | Zheng et al. |
| 2009/0046473 | A1 | 2/2009 | Wen-Kuei |
| 2009/0059559 | A1 | 3/2009 | Pabst et al. |
| 2009/0080187 | A1 | 3/2009 | Chou |
| 2009/0160363 | A1 | 6/2009 | Negley |
| 2009/0161356 | A1 | 6/2009 | Negley et al. |
| 2009/0190312 | A1 | 7/2009 | Katayama et al. |
| 2009/0245308 | A1 | 10/2009 | Yu et al. |
| 2009/0261268 | A1 | 10/2009 | Schwiebert et al. |
| 2009/0288807 | A1 | 11/2009 | Yang et al. |
| 2010/0165635 | A1 | 7/2010 | Chen et al. |
| 2010/0237760 | A1 | 9/2010 | Yang |
| 2010/0277069 | A1 | 11/2010 | Janik et al. |
| 2010/0314985 | A1* | 12/2010 | Premysler ..... 313/46 |
| 2010/0327725 | A1 | 12/2010 | Huang et al. |
| 2011/0080740 | A1* | 4/2011 | Allen ..... F21V 3/00 362/294 |
| 2012/0075854 | A1 | 3/2012 | Maxik et al. |
| 2012/0224374 | A1 | 9/2012 | Aliberti |
| 2012/0300474 | A1* | 11/2012 | Jung ..... F21K 9/13 362/373 |

FOREIGN PATENT DOCUMENTS

| | | |
|---|---|---|
| KR | 20100003326 | 1/2010 |
| WO | 2009/073394 | 6/2009 |
| WO | 2009/091562 | 7/2009 |

OTHER PUBLICATIONS 2007-0139923 (U.S. Appl. No. 11/613,692), Jun. 21, 2007 (filed Dec. 20, 2006), Negley.
2007-0236911 (U.S. Appl. No. 11/614,180), Oct. 11, 2007 (filed Dec. 21, 2006), Negley.
2010/0020532 (U.S. Appl. No. 12/570,712), Jan. 28, 2010 (filed Sep. 30, 2009), Negley.
2007-0139920 (U.S. Appl. No. 11/613,714), Jun. 21, 2007 (filed Dec. 20, 2006), Van de Ven.
2007-0137074 (U.S. Appl. No. 11/613,733), Jun. 21, 2007 (filed Dec. 20, 2006), Van de Ven.
2007-0170447 (U.S. Appl. No. 11/624,811), Jul. 26, 2007 (filed Jan. 19, 2007), Negley.
2007-0171145 (U.S. Appl. No. 11/626,483), Jul. 26, 2007 filed Jan. 24, 2007, Coleman.
2007-0263393 (U.S. Appl. No. 11/743,754), Nov. 15, 2007 (filed May 3, 2007), Van de Ven.
2007-0274080 (U.S. Appl. No. 11/751,982), Nov. 29, 2007 (filed May 22, 2007), Negley.
2007-0280624 (U.S. Appl. No. 11/753,103), Dec. 6, 2007 (filed May 24, 2007), Negley.
2007-0274063 (U.S. Appl. No. 11/751,990), Nov. 29, 2007 (filed May 22, 2007), Negley.
2007-0278934 (U.S. Appl. No. 11/736,761), Dec. 6, 2007 (filed Apr. 18, 2007), Van de Ven.
2007-0267983 (U.S. Appl. No. 11/736,799), Nov. 22, 2007 (filed Apr. 18, 2007), Van de Ven.
2007-0278503 (U.S. Appl. No. 11/737,321), Dec. 6, 2007 (filed Apr. 19, 2007), Van de Ven.
2007-0278974 (U.S. Appl. No. 11/755,149), Dec. 6, 2007 (filed May 30, 2007), Van de Ven.
2007-0279903 (U.S. Appl. No. 11/755,153), Dec. 6, 2007 (filed May 30, 2007), Negley.
2007-0279440 (U.S. Appl. No. 11/755,162), Dec. 6, 2007 (filed May 30, 2007), Negley.
2008-0084700 (U.S. Appl. No. 11/856,421), Apr. 10, 2008 (filed Sep. 17, 2007), Van de Ven.
2008-0088248 (U.S. Appl. No. 11/854,744), Apr. 17, 2008 (filed Sep. 13, 2007), Myers.
2008-0084701 (U.S. Appl. No. 11/859,048), Apr. 10, 2008 (filed Sep. 21, 2007), Van de Ven.
2008-0112183 (U.S. Appl. No. 11/939,047), May 15, 2008 (filed Nov. 13, 2007), Negley.
2008-0106895 (U.S. Appl. No. 11/936,163), May 8, 2008 (filed Nov. 7, 2007), Van de Ven.
2008-0304260 (U.S. Appl. No. 12/117,122), Dec. 11, 2008 (filed May 8, 2008), Van de Ven.

(56) References Cited

OTHER PUBLICATIONS 2008-0278940 (U.S. Appl. No. 12/117,131), Nov. 13, 2008 (filed May 8, 2008), Van de Ven.
2008-0278928 (U.S. Appl. No. 12/117,136), Nov. 13, 2008 (filed May 8, 2008), Van de Ven.
2008-0084685 (U.S. Appl. No. 11/843,243), Apr. 10, 2008 (filed Aug. 22, 2007), Van de Ven.
2008-0130285 (U.S. Appl. No. 11/948,021), Jun. 5, 2008 (filed Nov. 30, 2007), Negley.
2009-0296384 (U.S. Appl. No. 12/475,850), Dec. 3, 2009 filed Jun. 1, 2009, Van de Ven.
2008-0112168 (U.S. Appl. No. 11/939,052), May 15, 2008 (filed Nov. 13, 2007), Pickard.
2008-0112170 (U.S. Appl. No. 11/939,059), May 15, 2008 (filed Nov. 13, 2007), Trott.
2008-0106907 (U.S. Appl. No. 11/877,038), May 8, 2008 (filed Oct. 23, 2007), Trott.
2009-0184616 (U.S. Appl. No. 12/248,220), Jul. 23, 2009 (filed Oct. 9, 2008), Van de Ven.
2008-0089053 (U.S. Appl. No. 11/870,679), Apr. 17, 2008 (filed Oct. 11, 2007) Negley.
2008-0136313 (U.S. Appl. No. 11/951,626), Jun. 12, 2008 (filed Dec. 6, 2007), Van de Ven.
2008-0137347 (U.S. Appl. No. 11/948,041), Jun. 12, 2008 (filed Nov. 30, 2007), Trott.
2008-0259589 (U.S. Appl. No. 12/035,604), Oct. 23, 2008 (filed Feb. 22, 2008), Van de Ven.
2008-0304269 (U.S. Appl. No. 12/114,994), Dec. 11, 2008 (filed May 5, 2008), Pickard.
2008-0278952 (U.S. Appl. No. 12/116,341), Nov. 13, 2008 (filed May 7, 2008), Trott.
2008-0304261 (U.S. Appl. No. 12/117,148), Dec. 11, 2008 (filed May 8, 2008), Van de Ven.
2008-0309255 (U.S. Appl. No. 12/117,280), Dec. 18, 2008 (filed May 8, 2008), Myers.
2009-0108269 (U.S. Appl. No. 12/017,676), Apr. 30, 2009 (filed Jan. 22, 2008), Negley.
2009-0161356 (U.S. Appl. No. 12/277,745), Jun. 25, 2009 (filed Nov. 25, 2008), Negley.
2009-0160363 (U.S. Appl. No. 12/257,804), Jun. 25, 2009 (filed Oct. 24, 2008), Negley.
2009-0184666 (U.S. Appl. No. 12/328,144), Jul. 23, 2009 (filed Dec. 4, 2008), Myers.
2008-0278950 U.S. Appl. No. 12/116,346), Nov. 13, 2008 (filed May 7, 2008), Pickard.
2008-0278957 (U.S. Appl. No. 12/116,348), Nov. 13, 2008 (filed May 7, 2008), Pickard.
U.S. Appl. No. 12/535,319, filed Aug. 4, 2009, Van de Ven.
2010-0102697 (U.S. Appl. No. 12/512,653), Apr. 29, 2010 (filed Jul. 30, 2009), Van de Ven.
2010-0102199 (U.S. Appl. No. 12/469,819), Apr. 29, 2010 (filed May 21, 2008), Negley.
2010-0103678 (U.S. Appl. No. 12/469,828), Apr. 29, 2010 (filed May 21, 2008), Van de Ven.
2009-0184662 (U.S. Appl. No. 12/328,115), Jul. 23, 2009 (filed Dec. 4, 2008), Given.
2008-0130298 (U.S. Appl. No. 11/947,392), Jun. 5, 2008 (filed Nov. 29, 2007), Negley.
2009/0283779 (U.S. Appl. No. 12/475,261), Nov. 19, 2009 (filed May 29, 2009), Negley.
U.S. Appl. No. 12/476,356, filed Jun. 2, 2009.
2009/0046473 (U.S. Appl. No. 11/876,778), Feb. 19, 2009 (filed Oct. 23, 2007), Tsai et al.
Gernert, Nelson, *Active heat sink technology delivers added performance*, Electronic Products, Developments in active heat sink technology, pp. 1-4 (To the best knowledge of the undersigned this reference was first accessed by a representative of the firm of the undersigned on Dec. 8, 2009.).
ANSI C78.20-2003, Revision of C78.20-1995, American National Standard for electric lamps—A, G, PS and Similar Shapes with E26 Medium Screw Bases, (Oct. 2003), pp. 1-48.
Computer Cooling, Electronics Cooling, . . . , SynJet® Technology: Overview, www.noventix.com/technology, pp. 1-2 (To the best knowledge of the undersigned this reference was first accessed by a representative of the firm of the undersigned on Dec. 8, 2009.).
Cooligy's Active Microchannel Cooling System, www.frostytech.com/articleview.cfm,pp. 1-2 (To the best knowledge of the undersigned this reference was first accessed by a representative of the firm of the undersigned on Dec. 8, 2009.).
EE Times, Pin-fin heat sink integrates fan, www.eetimes.com/showarticle.jhtml, (Nov. 2009), pp. 1-2 (To the best knowledge of the undersigned this reference was first accessed by a representative of the firm of the undersigned on Dec. 8, 2009.).
Indian origin scientists microchip-sized fan produces enough wind to cool a laptop, thaindian.com/.../indian-origin-scientist . . . , Mar. 19, 2008, pp. 1-2.
Ionic Wind-Chillin' the PC, http://thefutureofthings.com/articles.p . . . , Jan. 2, 2007, pp. 1-5.
LED *PARFECTION*™, The Perfectly Designed Green Lighting Solution, http//www.litetronics.com/advertising/led-parfection-perfectly-designed.html (To the best knowledge of the undersigned this reference was first accessed by a representative of the firm of the undersigned on Aug. 18, 2010.).
Philips, *Philips First to Submit to Department of Energy L PRIZE$^{SM}$ Competition with Development of LED Replacment for Common Household Bulb*, Philips L PRIZE$^{SM}$ Press Information, Sep. 24, 2009, pp. 1-3.
Coyne et al., *Giant Magnetoresistance: The Really Big Idea Behind a Very Tiny Tool*, Magnet Lab, www.magnet.fsu.edu/education/.../gmr/, pp. 1-4 (To the best knowledge of the undersigned this reference was first accessed by a representative of the firm of the undersigned on Dec. 8, 2009.).
Dan Schlitz, *Dan Schlitz of Thorrn Micro Technologies, Inc., Describes Innovative Micro-fan Technology*, National Science Foundation, Press Release 08-041-Video, nsf.gov/news/news_videos.jsp?cntn_id . . . , pp. 1 (To the best knowledge of the undersigned this reference was first accessed by a representative of the firm of the undersigned on Dec. 14, 2009.).
Nuventix, *Cooling LEDs is no longer a design obstacle*, Dual DLM Brochure, www.nuventix.com/led_cooling, pp. 1-4 (To the best knowledge of the undersigned this reference was first accessed by a representative of the firm of the undersigned on Dec. 8, 2009.).
Nuventix, *SynJet® PAR20 LED Cooler with Heat Sink*, Design Guide, Version 1.0, Jul. 2009, pp. 1-33.
Piezo Fans, *PiezoFans, LLC brings the latest piezoelectric technology to cooling applications*, http://www.piezofans.com/piezofans.php, pp. 1-2 (To the best knowledge of the undersigned this reference was first accessed by a representative of the firm of the undersigned on Dec. 14, 2009.).
Daniel Schlitz, *SBIR Phase I: Compact Heat Sink using Microscale Ion Driven Air Flow*, Science Storm, sciencestorm.com/award/0340270.html, pp. 1-3 (To the best knowledge of the undersigned this reference was first accessed by a representative of the firm of the undersigned on Dec. 14, 2009.).
Daniel Schlitz, *SBIR Phase II: Miniature Cooling System for Laptop Computers*, Science Storm, sciencestorm.com/award/0522126.html, pp. 1-3 (To the best knowledge of the undersigned this reference was first accessed by a representative of the firm of the undersigned on Dec. 14, 2009.).
Daniel Schlitz, *Silent, microchip-sized 'fan' has no moving parts, yet produces enough wind to cool a laptop*, www.physorg.com/print125057974.html, Mar. 18th, 2008 in Technology/Semiconductors, pp. 1-2.
Thermacore, *Active Heat Sink Technology, AHST*, 2008, pp. 1.
Press Release 08-041, Tiny Torrents, National Science Foundation, nsf.gov/news/news_summ.jsp?cntn_id . . . , Mar. 17, 2008, pp. 1-3.
Jason Lombarg, *Toshiba to release highly-efficient LED bulbs*, http://www.ecnmag.com/news-Toshiba-LED-bulbs-100509.aspx, Oct. 5, 2009, pp. 1-2.
U.S. Appl. No. 13/089,807, filed Apr. 19, 2011, Pickard et al.
U.S. Appl. No. 13/622,763, filed Sep. 19, 2012, Curt Progl.

(56) References Cited

OTHER PUBLICATIONS 2011-0090686 (U.S. Appl. No. 12/582,206), Apr. 21, 2011 (filed Oct. 20, 2009), Pickard.
2011-0089838 (U.S. Appl. No. 12/607,355), Apr. 21, 2011 (filed Oct. 28, 2009), Pickard.
2011-0089830 (U.S. Appl. No. 12/683,886), Apr. 21, 2011 (filed Jan. 7, 2010), Pickard.

* cited by examiner

LIGHTING DEVICE COMPRISING SHIELD ELEMENT, AND SHIELD ELEMENT

CROSS-REFERENCE TO RELATED APPLICATIONS

This application claims the benefit of U.S. Provisional Patent Application No. 61/597,481, filed Feb. 10, 2012, the entirety of which is incorporated herein by reference as if set forth in its entirety.

FIELD OF THE INVENTIVE SUBJECT MATTER

In some aspects, the present inventive subject matter is directed to a lighting device, e.g., a device for general illumination. In some aspects, the present inventive subject matter relates to a lighting device that can be installed in a standard socket, e.g., a socket conventionally used for installing an incandescent lighting device, a fluorescent lighting device or any other type of lighting device, such as an Edison socket or a GU-24 socket, for example. In some aspects, the present inventive subject matter relates to such a lighting device that is of a size and/or shape that is relatively close to a size and/or shape of a conventional lamp (and/or that fits within the size and/or shape of a conventional lamp). In some aspects, the present inventive subject matter relates to a lighting device that can provide high efficiency and good CRI Ra over long lifetimes. In some aspects, the present inventive subject matter relates to a lighting device that comprises one or more solid state light emitters.

BACKGROUND

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Persons of skill in the art are familiar with, and have ready access to, a wide variety of types of light sources, and any suitable light source (or light sources) can be employed in lighting devices in accordance with the present inventive subject matter.

Representative examples of types of light sources include incandescent lights, fluorescent lamps, solid state light emitters, laser diodes, thin film electroluminescent devices, light emitting polymers (LEPs), halogen lamps, high intensity discharge lamps, electron-stimulated luminescence lamps, etc., with or without filters. That is, lighting devices in accordance with the present inventive subject matter can comprise a single light source, a plurality of light sources of a particular type, or any combination of one or more light sources of each of a plurality of types.

Persons of skill in the art are also familiar with, and have ready access to, a wide variety of light sources (of any type or combination of types) that emit light of any hue, and any suitable hue-emitting light source (or light sources), or combination of hue-emitting light sources, can be employed in lighting devices in accordance with the present inventive subject matter. While there is a need for lighting devices that provide more efficient white lighting, there is in general a need for lighting devices that provide more efficient lighting in all hues.

In some aspects, the present inventive subject matter is directed to lighting devices that comprise one or more solid state light emitters (e.g., one or more LEDs and/or one or more luminescent materials). While there is much discussion herein of the merits of solid state light emitters, many aspects of the present inventive subject matter as discussed herein can, if desired, be applied to lighting devices that comprise other types of light sources (rather than or in addition to one or more solid state light emitters), e.g., incandescent light sources, fluorescent light sources, etc. Similarly, while there is much discussion herein of lighting devices that emit white light, the present inventive subject matter is applicable to lighting devices that emit light of any desired hue.

Solid state light emitters (e.g., light emitting diodes) are receiving much attention due to their energy efficiency. It is well known that incandescent light bulbs are very energy-inefficient light sources—about ninety percent of the electricity they consume is released as heat rather than light. Fluorescent light bulbs are more efficient than incandescent light bulbs (by a factor of about 10), but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent light bulbs have longer lifetimes than incandescent light bulbs (e.g., fluorescent bulbs typically have lifetimes of 10,000-20,000 hours), but provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light source (or light sources) is less than the lifetime of the fixture, the need for periodic change-outs is presented. The impact of the need to replace light sources is particularly pronounced where access is difficult (e.g., vaulted ceilings, bridges, high buildings, highway tunnels) and/or where change-out costs are extremely high.

General illumination lamps are typically rated in terms of their color reproduction. Color reproduction is typically measured using the Color Rendering Index (CRI Ra). CRI Ra is a modified average of the relative measurements of how the color rendition of a lamp compares to that of a reference radiator when illuminating eight reference colors, i.e., it is a relative measure of the shift in surface color of an object when lit by a particular lamp. The CRI Ra equals 100 if the color coordinates of a set of test colors being illuminated by the lamp are the same as the coordinates of the same test colors being irradiated by the reference radiator.

Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra). The color of visible light output by a light source, and/or the color of blended visible light output by a plurality of light emitters can be represented on either the 1931 CIE (Commission International de l'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). Each point (i.e., each "color point") on the respective Diagrams corresponds to a particular hue. For a technical description of CIE chromaticity diagrams, see, for example, "Encyclopedia of Physical Science and Technology", vol. 7, 230-231 (Robert A Meyers ed., 1987). The spectral colors are distributed around the boundary of the outlined space, which includes all of the hues perceived by the human eye. The boundary represents maximum saturation for the spectral colors.

The 1931 CIE Chromaticity Diagram can be used to define colors as weighted sums of different hues. The 1976 CIE Chromaticity Diagram is similar to the 1931 Diagram, except that similar distances on the 1976 Diagram represent similar perceived differences in color.

The expression "hue", as used herein, means light that has a color shade and saturation that correspond to a specific point on a CIE Chromaticity Diagram, i.e., a point that can be characterized with x,y coordinates on the 1931 CIE Chromaticity Diagram or with u', v' coordinates on the 1976 CIE Chromaticity Diagram.

In the 1931 Diagram, deviation from a point on the Diagram (i.e., "color point") can be expressed either in terms of the x, y coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues that would each be perceived as differing from the specified hue to a common extent (and likewise for loci of points defined as being spaced from a particular hue by other quantities of MacAdam ellipses).

A typical human eye is able to differentiate between hues that are spaced from each other by more than seven MacAdam ellipses (but is not able to differentiate between hues that are spaced from each other by seven or fewer MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$. This formula gives a value, in the scale of the u' v' coordinates, corresponding to the distance between points. The hues defined by a locus of points that are each a common distance from a specified color point consist of hues that would each be perceived as differing from the specified hue to a common extent.

A series of points that is commonly represented on the CIE Diagrams is referred to as the blackbody locus. The chromaticity coordinates (i.e., color points) that lie along the blackbody locus obey Planck's equation: $E(\lambda)=A\lambda^{-5}/(e^{(B/T)}-1)$, where E is the emission intensity, λ is the emission wavelength, T is the color temperature of the blackbody and A and B are constants. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants that produce light that is on or near the blackbody locus can thus be described in terms of their color temperature.

The most common type of general illumination is white light (or near white light), i.e., light that is close to the blackbody locus, e.g., within about 10 MacAdam ellipses of the blackbody locus on a 1931 CIE Chromaticity Diagram. Light with such proximity to the blackbody locus is referred to as "white" light in terms of its illumination, even though some light that is within 10 MacAdam ellipses of the blackbody locus is tinted to some degree, e.g., light from incandescent bulbs is called "white" even though it sometimes has a golden or reddish tint (e.g., light having a correlated color temperature of 1500 K or less is reddish).

Light emitting diodes are increasingly being used in lighting/illumination applications, such as traffic signals, color wall wash lighting, backlights, displays and general illumination, with one ultimate goal being a replacement for the ubiquitous incandescent light bulb.

The emission spectrum of any particular light emitting diode is typically concentrated around a single wavelength (as dictated by the light emitting diode's composition and structure), which is desirable for some applications, but not desirable for others, (e.g., for providing general illumination, such a narrow emission spectrum would, by itself, provide a very low CRI Ra).

Light that is perceived as white can be made by blending two or more colors (or wavelengths). "White" solid state light emitting lamps have been produced by providing devices that mix different colors of light, e.g., by using light emitting diodes that emit light of differing respective colors and/or by converting some or all of the light emitted from the light emitting diodes using luminescent material. For example, as is well known, some lamps (referred to as "RGB lamps") use red, green and blue light emitting diodes, and other lamps use (1) one or more light emitting diodes that generate blue light and (2) luminescent material (e.g., one or more phosphor materials) that emits yellow light in response to excitation by blue light emitted by the light emitting diode, whereby the blue light and the yellow light, when mixed, produce light that is perceived as white light.

In order to provide a broad spectrum light source (such as a white light source) in a lamp that comprises a relatively narrow spectrum light source (such as a light emitting diode) the relatively narrow spectrum of the light emitting diode may be shifted and/or spread in wavelength using one or more luminescent materials. For example, a "white" LED may be formed by coating a light emitting diode (e.g., one that emits blue light) with an encapsulant material, such as a resin or silicon, that includes therein a wavelength conversion material, such as a YAG:Ce phosphor, that emits yellow light in response to stimulation with blue light. Some, but not all, of the blue light that is emitted by the light emitting diode is absorbed by the phosphor, causing the phosphor to emit yellow light. The blue light emitted by the light emitting diode that is not absorbed by the phosphor combines with the yellow light emitted by the phosphor, to produce light that is perceived as white by an observer. Other combinations also may be used. For example, a red emitting phosphor can be mixed with a yellow phosphor to produce light having a different color temperature and/or better color rendering properties. Alternatively, one or more light emitting diodes that emit red light may be used to supplement light emitted by a blue light-emitting light emitting diode that is coated with a yellow light-emitting phosphor. In other alternatives, separate red, green and blue light emitting diodes may be used. Moreover, infrared (IR) or ultraviolet (UV) light emitting diodes may be used. Finally, any or all of such combinations (or other combinations) may be used analogously to produce hues other than white.

Lamps that comprise one or more solid state light emitters can offer a long operational lifetime relative to conventional incandescent and fluorescent bulbs. Lifetime of lamps that comprise one or more solid state light emitters is typically measured by an "L70 lifetime", i.e., a number of operational hours in which the light output of the lamp does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein.

Various embodiments are described herein with reference to "expected L70 lifetime." Because the lifetimes of lamps that comprise one or more solid state light emitters are typically measured in the tens of thousands of hours, it is generally impractical to perform full term testing to measure the lifetime of the product. Therefore, projections of lifetime from test data on the system and/or light source are used to project the lifetime of the system. Such testing methods include, but are not limited to, the lifetime projections found in the ENERGY STAR Program Requirements cited above or described by the ASSIST method of lifetime prediction, as described in "*ASSIST Recommends . . . LED Life For General Lighting: Definition of Life*", Volume 1, Issue 1, February 2005, the disclosure of which is hereby incorporated herein by reference as if set forth fully herein. Accordingly, the term "expected L70 lifetime" refers to the predicted L70 lifetime of a product as evidenced, for example, by the L70 lifetime projections of ENERGY STAR, ASSIST and/or a manufacturer's claims of lifetime.

Solid state light emitters, such as light emitting diodes or LEDs, may be energy efficient, so as to satisfy ENERGY STAR® program requirements. ENERGY STAR program requirements are defined in "*ENERGY STAR® Program Requirements for Solid State Lighting Luminaires, Eligibility Criteria—Version* 1.1", Final: Dec. 19, 2008, the disclosure of which is hereby incorporated herein by reference in its entirety as if set forth fully herein.

In order to encourage development and deployment of highly energy efficient solid state lighting (SSL) products to replace several of the most common lighting products currently used in the United States, including 60-watt A19 incandescent and PAR 38 halogen incandescent lamps, the Bright Tomorrow Lighting Competition (L Prize™) has been authorized in the Energy Independence and Security Act of 2007 (EISA). The L Prize is described in "*Bright Tomorrow Lighting Competition* (*L Prize*™)", May 28, 2008, Document No. 08NT006643, the disclosure of which is hereby incorporated herein by reference in its entirety as if set forth fully herein. The L Prize winner must conform to many product requirements including light output, wattage, color rendering index, correlated color temperature, expected lifetime, dimensions and base type.

BRIEF SUMMARY

Heat dissipation is a consideration with lamps that comprise any type (or combination of types) of light source (or light sources).

For example, in the case of lamps that comprise one or more light emitting diodes, heat dissipation is a particularly important concern in obtaining a desirable operational lifetime. As is well known, light emitting diodes generate heat during the generation of light. The heat is generally measured by a "junction temperature", i.e., the temperature of the semiconductor junction of the light emitting diode.

A challenge with light emitting diodes is that many light emitting diodes do not operate as well as possible when they are subjected to elevated junction temperatures. For example, many light emitting diode light sources have average operating lifetimes of decades (as opposed to just months or 1-2 years for many incandescent bulbs), but some light emitting diodes' lifetimes can be significantly shortened if they are operated at elevated temperatures.

In order to provide an acceptable lifetime for a light emitting diode, for example, an L70 of at least 25,000 hours, it is generally considered desirable to ensure that the junction temperature not exceed 85 degrees C. (and in some cases, it is considered desirable to ensure that junction temperature should not exceed not exceed 70 degrees C.). In order to ensure that junction temperature in light emitting diodes does not exceed 85 degrees C. (and in some cases, that junction temperature does not exceed 70 degrees C.), various heat sinking schemes have been developed to dissipate at least some of the heat that is generated by light emitting diodes. See, for example, Application Note: CLD-APO6.006, entitled *Cree® XLamp® XR Family* & 4550 *LED Reliability*, published at cree.com/xlamp, September 2008.

In addition, the intensity of light emitted from some light emitting diodes varies based on junction temperature, and the variance in intensity resulting from changes in junction temperature can be more pronounced for solid state light emitters that emit light of one color than for solid state light emitters that emit light of another color. For example, light emitting diodes that emit red light often have a very strong temperature dependence (e.g., AlInGaP light emitting diodes can reduce in optical output by ~20% when heated up by ~40 degrees C., that is, approximately −0.5% per degree C.; and blue InGaN+YAG:Ce light emitting diodes can reduce by about −0.15%/degree C.). In many instances where lamps comprise solid state light emitters as light sources (e.g., general illumination lamps that emit white light in which at least some of the light sources are light emitting diodes), a plurality of solid state light emitters are provided that emit light of different respective hues which, when mixed, are perceived as the desired color for the output light (e.g., white or near-white). With respect to such lamps, if the intensity of light emitted by some or all of the solid state light emitters varies as a result of temperature change, differences in how the brightness of emission of the respective light sources is affected by temperature change can throw of the balance of color needed to keep the hue of light emitted from the lamp at the desired hue (or within a desired range of hues). The desire to maintain a relatively stable color of light output therefore can be an important reason to try to effectively dissipate heat from light emitting diodes (e.g., to avoid having light emitting diodes reach elevated temperatures, e.g., temperatures exceeding 70 degrees C. or 85 degrees C.).

In some aspects of the present inventive subject matter, which can include or not include any of the features described elsewhere herein, there are provided lighting devices that provide excellent heat dissipation. In some aspects of the present inventive subject matter, there are provided lighting devices that comprise one or more solid state light emitters and that provide sufficient heat dissipation that the lighting device can continue to provide at least 70% of its initial wall plug efficiency for at least 25,000 hours of operation of the lighting device (and in some cases for at least 35,000 hours or 50,000 hours of operation of the lighting device).

The present inventive subject matter provides, in some aspects, shield elements (and lighting devices that comprise shield elements) that comprise one or more vents. In some of such embodiments, the one or more vents allow for air flow in and out of the shield element (i.e., from outside a space defined by portions of the shield element into the space, and from inside the space to outside the space), to enable enhanced dissipation of heat from within the space (e.g., heat that may be generated by one or more light sources that may be within the space).

In some embodiments in accordance with the present inventive subject matter, the shield element allows for air flow and "hides" the light source (or at least one light source) (i.e., it blocks the light source from direct view from some or all locations outside the shield element). In connection with such embodiments and other aspects, the present inventive subject matter relates to not only venting but also vent configurations.

In many instances, form factor limitations can impose unique challenges to thermal management of lighting devices, e.g., lighting devices that comprise one or more light emitting diodes. A wide variety of traditional solutions have sought to move heat to outer surfaces of lamps, wherefrom it can be carried away via natural convection. This has resulted in the development of a number of lighting devices with finned bases and half-dome tops. Phillips®, L-prize lamp differs from such designs, but it likewise relies on moving heat to external surfaces for cooling.

Some embodiments of lighting devices in accordance with the present inventive subject matter enable air (or other fluid or fluids, i.e., gas(es) and/or liquid(s)) to flow through one or more vents in the shield element, rather than just along outer surfaces of the shield element. As a result, such lighting devices in accordance with the present inventive subject matter can enable direct cooling of the light source(s) and can be fabricated in more traditional shapes (e.g., in A lamp shapes).

In accordance with one aspect of the present inventive subject matter, there is provided a lighting device that comprises a shield element and at least a first light source, the shield element comprising at least one vent through which fluid (e.g., gas) can pass to exit from the space.

In accordance with another aspect of the present inventive subject matter, there is provided a shield element that comprises at least one vent through which fluid (e.g., gas) can pass.

In accordance with a first aspect of the present inventive subject matter, there is provided a lighting device that comprises a shield element and at least a first light source, in which (1) the first light source is within a space defined by portions of the shield element, (2) the shield element comprises at least one vent through which fluid (e.g., gas and/or liquid) can pass to exit from the space, and (3) the shield element blocks the first light source from direct view from at least all locations outside the shield element that are to a first side of a plane extending through the first light source.

In some embodiments in accordance with the first aspect of the present inventive subject matter, which can include or not include, as suitable, any of the other features described herein, the plane extending through the first light source is an emission plane of the first light source.

In accordance with a second aspect of the present inventive subject matter, there is provided a lighting device that comprises a shield element and at least a first light source, in which (1) the shield element comprises regions that define an opening, (2) the first light source is within a space defined by portions of the shield element and the opening, (3) the shield element comprises at least one vent through which fluid (e.g., gas and/or liquid) can pass to exit from the space, and (4) the shield element blocks the first light source from direct view from at least all locations outside the shield element that are to a first side of a plane defined by at least portions of the opening.

In some embodiments in accordance with the second aspect of the present inventive subject matter, which can include or not include, as suitable, any of the other features described herein, a substantial entirety of a periphery of the opening is in the plane or is parallel to the plane.

In some embodiments in accordance with the second aspect of the present inventive subject matter, which can include or not include, as suitable, any of the other features described herein, the plane defined by at least portions of the opening is substantially parallel to an emission plane of the first light source.

In accordance with a third aspect of the present inventive subject matter, there is provided a shield element that comprises shield element regions that define a space, and at least first and second vents through which fluid (e.g., gas and/or liquid) can pass to exit from the space, in which (1) the first vent is substantially symmetrical with respect to a first axis, and (2) the second vent is substantially symmetrical with respect to the first axis.

In some embodiments in accordance with the second aspect of the present inventive subject matter, which can include or not include, as suitable, any of the other features described herein, the first vent comprises at least first and second vent portions, and the second vent comprises at least third and fourth vent portions.

In some embodiments in accordance with the present inventive subject matter, which can include or not include, as suitable, any of the other features described herein, outer surfaces of the shield element correspond to portions of a shape of an A lamp.

In some embodiments in accordance with the present inventive subject matter, which can include or not include, as suitable, any of the other features described herein, at least part of the shield element is substantially transparent.

The inventive subject matter may be more fully understood with reference to the accompanying drawings and the following detailed description of the inventive subject matter.

BRIEF DESCRIPTION OF THE DRAWING FIGURES

DETAILED DESCRIPTION

Figure 1:
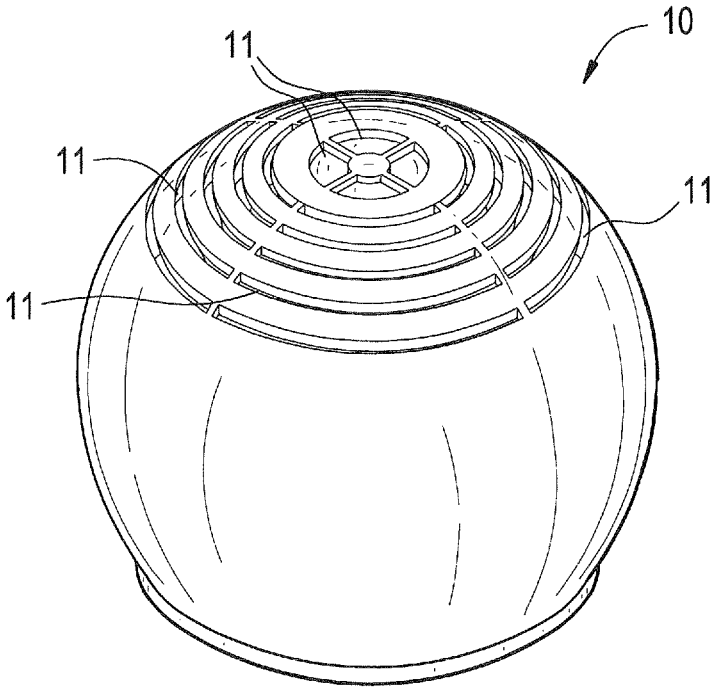
FIG. 1 is a top perspective view of a shield element 10 in accordance with the present inventive subject matter.

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout.

As used herein, the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on", being mounted "to", or extending "onto" another element, it can be in or on the other element, and/or it can be directly on the other element, and/or it can extend directly onto the other element, and it can be in direct contact or indirect contact with the other element (e.g., intervening elements may also be present). In contrast, when an element is referred to herein as being "directly on" or extending "directly onto" another element, there are no intervening elements present. Also, when an element is referred to herein as being "connected" or "coupled" to another element, it can be directly connected or coupled to the other element, or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perforin an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "top", "above," "horizontal" or "vertical" may be used herein to describe one element's relationship to another element (or to other elements). Such relative terms are intended to encompass different orientations of the device in addition to the orientation depicted in the Figures. For example, if the device is turned over, elements described as being on the "top" side would then be on a "bottom" sides.

The expression "illumination" (or "illuminated"), as used herein when referring to a light source, means that at least some current is being supplied to the light source to cause the light source to emit at least some electromagnetic radiation (e.g., visible light). The expression "illuminated" encompasses situations where the light source emits electromagnetic radiation continuously, or intermittently at a rate such that a human eye would perceive it as emitting electromagnetic radiation continuously or intermittently, or where a plurality of light sources of the same color or different colors are emitting electromagnetic radiation intermittently and/or alternatingly (with or without overlap in "on" times), e.g., in such a way that a human eye would perceive them as emitting light continuously or intermittently (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials that emit light of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "the first light source within a space defined by portions of the shield element" (and any similar expressions), as used herein, means that an imaginary shape that is of a maximum volume and that has outer surfaces that comprise (1) imaginary line segments between selected points on the shield element and (2) imaginary surfaces extending between respective said imaginary line segments, such that no point on the shield element lies outside the imaginary shape, the imaginary shape completely surrounds a space, and the first light source is within such space.

The expression "outer surfaces of the shield element," as used herein, means portions of the shield element that would be on or outside the surface of the "imaginary shape" described above.

The expression "the shield element comprising regions that define an opening," as used herein, means that the shield element comprises regions that define (in two dimensions or in three dimensions) a periphery of an opening (e.g., a circular opening, a rectangular opening, or an opening of any other regular or irregular shape).

The expression "the first light source within a space defined by portions of the shield element and the opening," as used herein, means that an imaginary shape that is of a maximum volume and that has outer surfaces that comprise (1) imaginary line segments between selected points on the shield element, (2) imaginary surfaces extending between respective said imaginary line segments, and (3) one or more imaginary surface that fills an area defined by the opening, such that no point on the shield element or the opening lies outside the imaginary shape, the imaginary shape completely surrounds a space, and the first light source is within such space.

The expression "the shield element blocking the first light source from direct view from at least all locations outside the shield element that are to a first side of a plane extending through the first light source," as used herein, means that there is no substantially straight imaginary line segment (e.g., line of vision) that extends from (1) a location that is to one side of the plane to (2) a location on the first light source (i.e., a point from which light is emitted) that does not pass through at least a first portion of the shield element. In the sense that the shield element blocks the first light source from direct view from at least some locations, the shield element "shields" the first light source from direct view from such locations (or would be capable of "shielding" a light source from direct view from some locations if such a light source were located in a certain position or positions relative to the shield element).

The expression "emission plane of the first light source," (e.g., "the emission plane of the first solid state light emitter"), as used herein, means (1) a plane that is perpendicular to an axis of the light emission from the first light source (e.g., in a case where light emission is hemispherical, the plane would be along the flat part of the hemisphere; in a case where light emission is conical, the plane would be perpendicular to the axis of the cone), (2) a plane that is perpendicular to a direction of maximum brightness of light emission from the first light source (e.g., in a case where the maximum light emission is vertical, the plane would be horizontal), (3) a plane that is perpendicular to a mean direction of light emission (in other words, if the maximum brightness is in a first direction, but a brightness in a second direction ten degrees to one side of the first direction is larger than a brightness in a third direction ten degrees to an opposite side of the first direction, the mean brightness would be moved somewhat toward the second direction as a result of the intensities in the second direction and the third direction).

The expression "substantially transparent", as used herein, means that the structure which is characterized as being substantially transparent allows passage of at least 90% of incident visible light.

The expression "substantially symmetrical", as used herein, when referring to a shape or a structure, means that the shape or structure is symmetrical or could be made symmetrical by removing a specific region or regions which in total comprise not more than about 10 percent of its volume (and/or its surface area) and/or by adding a specific region or regions which in total comprise not more than about 10 percent of its volume (and/or its surface area).

The expression "substantially parallel," as used herein when referring to two planes, means that the two planes do not diverge from each other by more than five degrees.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As discussed above, in accordance with each of a first aspect and a second aspect of the present inventive subject matter, there is provided a lighting device that comprises a shield element and at least a first light source. As discussed above, in accordance with a third aspect of the present inventive subject matter, there is provided a shield element.

A shield element in accordance with the present inventive subject matter can be made of any suitable material or combination of materials (e.g., polycarbonate, acrylic, any translucent plastic, glass, etc.), and can be of any suitable shape. A wide variety of suitable materials (and combinations of materials) will be readily apparent to persons of skill in the art, as will a wide variety of suitable shapes.

In some embodiments in accordance with the present inventive subject matter, a shield element can be fabricated by joining two or more pieces together (e.g., a shield element can be split into two pieces which are joined together during assembly, or a vented element and a globe with an open region could be formed separately and then the vented element could be fitted into the open region and joined to the globe), or a first element could be formed and then additional material could be overmolded onto the first element in a single overmolding or a series of two or more overmoldings. In such embodiments, part of all of the regions where pieces of the shield element are joined together or overmolded can be hidden (or made to less readily visible) by appropriate positioning of one or more vents. Joining elements together can be accomplished in any suitable way, persons of skill in the art being familiar with a variety of possibilities (e.g., sonically welding). In some aspects of the present invention, there can be provided a first element that comprises a space (or an opening), and a number of different types of elements with one or more vents that have different properties, are made of different materials, and/or have different arrangements of vents, whereby a first element can be provided and then a second element can be selected based on a property that is desired (e.g., reflectivity (there is a discussion below of imparting reflectivity), a material that is desired (e.g., made from polycarbonate, acrylic, glass), and/or a desired arrangement of one or more vents), and the selected second element can then be joined to the first element (e.g., by welding or by overmolding) to provide a lighting device that exhibits desired properties. Likewise, the first element could be selected from among a number of alternatives for first elements, and/or a lighting device could be assembled by combining more than two elements (any of which could be selected from any number of possible alternatives).

In some embodiments in accordance with the present inventive subject matter, which can include or not include, as suitable, any of the other features described herein, In some embodiments in accordance with the present inventive subject matter, which can include or not include, as suitable, any of the other features described herein, a shield element comprises at least one vent through which fluid (e.g., gas and/or liquid) can pass. Any such vent or vents can be of any suitable shape (or shapes) and size (or sizes), i.e., in a shield element that has two or more vents, (1) the shape(s) of one or more vents can be the same as or different from the shape(s) of any other vent in the shield element, and/or (2) the size(s) of one or more vents can be the same as or different from the size(s) of any other vent in the shield element.

In some embodiments in accordance with the present inventive subject matter, which can include or not include, as suitable, any of the other features described herein, at least part of the shield element is substantially transparent (and in some embodiments, a substantial entirety of the shield element is substantially transparent).

As noted above, in accordance with a first aspect of the present inventive subject matter, there is provided a lighting device that comprises a shield element and at least a first light source, in which the first light source is within a space defined by portions of the shield element, and the shield element comprises at least one vent through which fluid (e.g., gas and/or liquid) can pass to exit from the space.

As noted above, in accordance with a second aspect of the present inventive subject matter, there is provided a lighting device that comprises a shield element and at least a first light source, in which the shield element comprises regions that define an opening, the first light source is within a space defined by portions of the shield element and the opening, and the shield element comprises at least one vent through which fluid (e.g., gas and/or liquid) can pass to exit from the space.

As noted above, in accordance with a third aspect of the present inventive subject matter, there is provided a shield element, comprising shield element regions that define a space, and at least first and second vents through which fluid (e.g., gas and/or liquid) can pass to exit from the space.

In some embodiments in accordance with the present inventive subject matter, there are provided shield elements (or lighting devices that comprise shield elements) that comprise vents on plural locations, e.g., so that no matter how the shield element (or lighting device) is oriented, one of the vents is above (at least to some extent) another of the vents, so that air can exit the space defined by portions of the shield element (i.e., pass from the space through a vent to a location that is outside the space) at a location that is higher (at least to some extent) than a location through which it entered the space.

In some embodiments in accordance with the present inventive subject matter, which may include or not include any other feature described herein, when at least a first light source generates heat, at least some of such heat is dissipated in ambient medium located in the space, thereby causing convective flow, i.e., causing the ambient medium located inside the space to absorb heat, which causes the ambient medium located inside the space to rise and exit through a vent (or an opening), which thereby generates negative pressure within the space and which causes ambient medium that is outside the space to enter the space (and in some embodiments, at least some of the ambient medium that exits the space exits the space in a direction that is at least upward to some degree, and at least some of the ambient medium that enters the space enters the space in a direction that is likewise at least upward to some degree (whereby the negative pressure generated by fluid exiting the space assists in pulling incoming fluid into the space).

In some embodiments in accordance with the present inventive subject matter, one or more portions of a shield element can comprise one or more optical features formed on its surface and/or within. Additionally or alternatively, any portion of a shield element can be coated with a diffuse coating. Persons of skill in the art are familiar with a variety of materials that can be used to provide a diffuse coating (i.e., a coating that enhances diffusion of light), and any of such materials can be used.

In some embodiments in accordance with the present inventive subject matter, one or more portions of a shield element (e.g., one or more portions that define or border on a vent) can be reflective. The ability to reflect light can be provided or imparted in any suitable way, a variety of which are well known to persons of skill in the art. For example, a reflective portion can comprise one or more material that is reflective (and/or specular, the term "reflective" being used herein to refer to reflective and optionally also specular), and/or that can be treated (e.g., polished) so as to be reflective, or can comprise one or more material that is non-reflective or only partially reflective and that is coated with, laminated to and/or otherwise attached to a reflective material. Persons of skill in the art are familiar with a variety of materials that are reflective, e.g., metals such as aluminum or silver, a dielectric stack of materials forming a Bragg Reflector, a dichroic reflector coating on glass (e.g., as described at www.lumascape.com/pdf/literature/C1087US.pdf), any other thin film reflectors, etc. Persons of skill in the art are familiar with a wide variety of materials which are suitable for making a non-reflective or partially reflective structure which can be coated with, laminated to or otherwise attached to a reflective material, including for instance plastic materials such as polyethylene, polypropylene, natural or synthetic rubbers, polycarbonate or polycarbonate copolymer, PAR (poly(4,4'-isopropylidenediphenylene terephthalate/isophthalate) copolymer), PEI (polyetherimide), and LCP (liquid crystal polymer). A reflective portion can be formed out of highly reflective aluminum sheet with various coatings, including silver, from companies like Alanod (http://www.alanod.de/opencms/alanod/index.html_2063069299.html.), or can be formed of glass.

As noted above, a shield element can take any of a wide variety of shapes, and can include one or more vents of any of a wide variety of shapes and sizes (and can optionally comprise one or more reflective regions), which could in many instances be expected to affect the pattern(s) of light emitted from light source(s) in many complicated ways. With any of such lighting devices, persons of skill in the art are familiar with experimenting with and adjusting light affecting shapes and structures so as to achieve desired light focusing, light directing, and/or light mixing properties.

A light source employed in a lighting system in accordance with the present inventive subject matter can be any suitable light source, a wide variety of which are well known to persons of skill in the art.

Persons of skill in the art are familiar with, and have ready access to, a wide variety of light sources of different colors, and any suitable light sources can be employed in accordance with the present inventive subject matter.

Representative examples of types of light sources include incandescent lights, fluorescent lamps, solid state light emitters, laser diodes, thin film electroluminescent devices, light emitting polymers (LEPs), halogen lamps, high intensity discharge lamps, electron-stimulated luminescence lamps, etc., with or without filters. That is, the at least one light source can comprise a single light source, a plurality of light sources of a particular type, or any combination of one or more light sources of each of a plurality of types. While there is much discussion herein of the merits of solid state light emitters, many aspects of the present inventive subject matter as discussed herein can be applied to other light sources, e.g., incandescent light sources, fluorescent light sources, etc.

Persons of skill in the art are familiar with, and have ready access to, a wide variety of solid state light emitters, and any suitable solid state light emitter (or solid state light emitters) can be employed as a light source in accordance with the present inventive subject matter. Representative examples of solid state light emitters include light emitting diodes (inorganic or organic, including polymer light emitting diodes (PLEDs)) and a wide variety of luminescent materials, as well as combinations (e.g., one or more light emitting diodes and/or one or more luminescent materials).

Persons of skill in the art are familiar with, and have ready access to, a variety of solid state light emitters that emit light having desired peak emission wavelength (or range of wavelengths) and/or dominant emission wavelength (or range of wavelengths), and any of such solid state light emitters (discussed in more detail below), or any combinations of such solid state light emitters, can be employed in embodiments that comprise one or more solid state light emitters.

Solid state light emitters, such as LEDs, may be energy efficient, so as to satisfy ENERGY STAR® program requirements. ENERGY STAR program requirements for LEDs are defined in "*ENERGY STAR® Program Requirements for Solid State Lighting Luminaires, Eligibility Criteria-Version* 1.1", Final: Dec. 19, 2008, the disclosure of which is hereby incorporated herein by reference in its entirety as if set forth fully herein.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Light emitting diodes can offer a long operational lifetime relative to conventional incandescent and fluorescent bulbs. Light emitting diode lifetime is typically measured by an "L70 lifetime", i.e., a number of operational hours in which the light output of a LED lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein, and/or using the lifetime projections found in the ENERGY STAR Program Requirements cited above or described by the ASSIST method of lifetime prediction, as described in "*ASSIST Recommends . . . LED Life For General Lighting: Definition of Life*", Volume 1, Issue 1, February 2005, the disclosure of which is hereby incorporated herein by reference as if set forth fully herein.

In some aspects of the present inventive subject matter, which can include or not include any of the features described elsewhere herein, there are provided lighting devices that can provide an expected L70 lifetime of at least 25,000 hours. Lighting devices according to some embodiments of the present inventive subject matter provide expected L70 lifetimes of at least 35,000 hours or at least 50,000 hours.

A luminescent material is a material that emits a responsive radiation (e.g., visible light) when excited by a source of exciting radiation. In many instances, the responsive radiation has a wavelength (or hue) that is different from the wavelength (or hue) of the exciting radiation.

Luminescent materials can be categorized as down-converting, i.e., a material that converts photons to a lower energy level (longer wavelength) or up-converting, i.e., a material that converts photons to a higher energy level (shorter wavelength).

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

One type of luminescent material are phosphors, which are readily available and well known to persons of skill in the art. Other examples of luminescent materials include scintillators, day glow tapes and inks that glow in the visible spectrum upon illumination with ultraviolet light.

One or more luminescent materials can be provided in any suitable form. For example, luminescent material(s) can be embedded in a resin (i.e., a polymeric matrix), such as a silicone material, an epoxy material, a glass material or a metal oxide material, and/or can be applied to one or more surfaces of a resin, to provide a lumiphor.

In general, light of any combination and number of colors can be mixed in lighting devices according to the present inventive subject matter. As noted above, persons of skill in the art are familiar with a wide variety of types of light sources, each of which can emit light of any suitable hue.

In the case of light emitting diodes, the emission spectrum of any particular light emitting diode is typically concentrated around a single wavelength (as dictated by the light emitting diode's composition and structure). As a result, in many cases (e.g., to make devices that emit light perceived as white or near-white, and/or to make devices that emit light with high CRI Ra, and/or to make devices that emit light of a hue that differs from that of each of the individual light sources, and/or to make devices that emit light that is not highly saturated), light sources that emit light of differing hues are employed in lighting devices that include light emitting diodes (e.g., one or more solid state light emitters and optionally also one or more other types of light sources, e.g., additional light emitting diodes, luminescent materials, incandescent lights, etc.).

With respect to lighting devices that comprise light sources that emit light in two or more respective hues, there are a variety of reasons that one or more of the light sources might cease emitting light and/or vary in their brightness of light emission, and/or vary in the hue being emitted, which can throw off the balance of color output and cause the lighting device to emit light that is perceived as being of a color that differs from the desired color of light output.

In the case of solid state light emitters, one example of a reason that one or more solid state light emitters might vary in their brightness of light emission is temperature change (resulting, e.g., from change in ambient temperature and/or heating up of the solid state light emitters). Some types of solid state light emitters (e.g., solid state light emitters that emit light of different colors) experience differences in brightness of light emission (if supplied with the same current) at different temperatures, and frequently such changes in brightness occur to differing extents for emitters that emit light of different colors as temperature changes. For example, light emitting diodes that emit red light often have a very strong temperature dependence (e.g., AlInGaP light emitting diodes can reduce in optical output by ~20% when heated up by ~40 degrees C., that is, approximately −0.5% per degree C.; and blue InGaN+YAG:Ce light emitting diodes can reduce by about −0.15%/degree C.).

Another example of a reason that one or more solid state light emitters (or other light sources) might vary in their brightness of light emission is aging. Some solid state light emitters (e.g., solid state light emitters that emit light of different colors) experience decreases in brightness of light emission (if supplied with the same current) as they age, and frequently such decreases in brightness occur at differing rates for solid state light emitters that emit light of different colors.

Another example of a reason that one or more solid state light emitters (or other light sources) might vary in their brightness of light emission is damage to the solid state light emitter(s) (or other light sources) and/or damage to circuitry that supplies current to the solid state light emitter(s) (or other light sources).

As mentioned above, with regard to lighting devices that comprise two or more light sources, any suitable combination of light sources can be employed. For example, respective light sources can be of different types (e.g., there can be two incandescent light sources, one fluorescent light source and three solid state light emitter sources), and/or they can emit light of differing hues (e.g., there can be two incandescent light sources that emit light of a first hue, one fluorescent light source that emits light of a second hue, three light emitting diodes that emit light of a third hue, one light emitting diode that emits light of a fourth hue, and one luminescent material (packaged with each of the three light emitting diodes that emit light of a third hue) that emits light of a fifth hue; alternatively, there can be just three light emitting diodes that emit light of a first hue, one light emitting diode that emits light of a second hue, and one luminescent material (packaged with each of the three light emitting diodes that emit light of a first hue) that emits light of a third hue.

Below are discussions of a number of representative examples of combinations of light sources that could be employed in accordance with the present inventive subject matter.

(1) There can be provided a lighting device that comprises (a) a first light source (or combination of light sources, e.g., one or packages that each comprise one or more light emitting diodes that emit light having dominant wavelength in the range of from about 400 nm to about 480 nm and one or more luminescent material that emits light having dominant wavelength in the range of from about 500 nm to about 585 nm) that emits light that has x, y color coordinates (on a 1931 CIE Chromaticity Diagram) which define a point that is within a first area on the 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38, and (b) a second light source (or combination of light sources, e.g., one or more light emitting diodes that emit light having dominant wavelength in the range of from about 600 nm to about 640 nm) that emits light having dominant wavelength in the range of from about 600 nm to about 800 nm or from about −495 nm to about −540 nm.

Some of the wavelength values in the preceding paragraph (and in paragraphs below) are negative quantities. Negative wavelength values mean that the wavelength value is a complementary color dominant, i.e., the wavelength cannot be specified with a standard dominant because the color point is on the red-purple boundary—in such situations, by convention, the color point is reflected through the point E, i.e., 0.333, 0.333 (on the 1931 Chromaticity Diagram) onto the border of the 1931 Chromaticity Diagram; that is, the color point that has a wavelength of −568 nm is identified as such because by drawing a ray that starts at the color point (along the red-purple boundary on the border of the 1931 Chromaticity Diagram) and passes through E, the ray will again intersect the border of the color diagram at 568 nm.

(2) There can be provided a lighting device that comprises (a) a first light source (or combination of light sources) that emits light that has x, y color coordinates (on a 1931 CIE Chromaticity Diagram) which define a point that is within a second area on the 1931 CIE Chromaticity Diagram enclosed by sixth, seventh, eighth, ninth and tenth line segments, the fifth line segment connecting a fifth point to a sixth point, the seventh line segment connecting the seventh point to an eighth point, the eighth line segment connecting the eighth point to a ninth point, the ninth line segment connecting the ninth point to a tenth point, and the tenth line segment connecting the tenth point to the sixth point, the sixth point having x, y coordinates of 0.29, 0.36, the seventh point having x, y coordinates of 0.32, 0.35, the eighth point having x, y coordinates of 0.41, 0.43, the ninth point having x, y coordinates of 0.44, 0.49, and the tenth point having x, y coordinates of 0.38, 0.53 (in the 1976 CIE Chromaticity Diagram, the sixth point has u', v' coordinates of 0.17, 0.48, the seventh point has u', v' coordinates of 0.20, 0.48, the eighth point has u', v' coordinates of 0.22, 0.53, the ninth point has u', v' coordinates of 0.22, 0.55, and the tenth point has u', v' coordinates of 0.18, 0.55), and (b) a second light source (or combination of light sources) that emits light having dominant wavelength in the range of from about 600 nm to about 800 nm or from about −495 nm to about −540 nm.

(3) There can be provided a lighting device that comprises (a) a first light source (or combination of light sources) that emits light that has x, y color coordinates (on a 1931 CIE Chromaticity Diagram) which define a point that is within a third area on the 1931 CIE Chromaticity Diagram enclosed by eleventh, twelfth, thirteenth and fourteenth line segments, the eleventh line segment connecting an eleventh point to a twelfth point, the twelfth line segment connecting the twelfth point to a thirteenth point, the thirteenth line segment connecting the thirteenth point to a fourteenth point, the fourteenth line segment connecting the fourteenth point to the eleventh point, the eleventh point having x, y coordinates of 0.57, 0.35, the twelfth point having x, y coordinates of 0.62, 0.32, the thirteenth point having x, y coordinates of 0.37, 0.16, and the fourteenth point having x, y coordinates of 0.40, 0.23, and (b) a second light source (or combination of light sources) that emits light having dominant wavelength in the range of from about 495 nm to about 580 nm.

(4) There can be provided a lighting device that comprises (a) a first light source (or combination of light sources) that emits light that has x, y color coordinates (on a 1931 CIE Chromaticity Diagram) which define a point that is within a fourth area on the 1931 CIE Chromaticity Diagram enclosed by fifteenth, sixteenth, seventeenth, eighteenth and nineteenth line segments, the fifteenth line segment connecting a fifteenth point to a sixteenth point, the sixteenth line segment connecting the sixteenth point to a seventeenth point, the seventeenth line segment connecting the seventeenth point to an eighteenth point, the eighteenth line segment connecting the eighteenth point to a nineteenth point, and the nineteenth line segment connecting the nineteenth point to the fifteenth point, the fifteenth point having x, y coordinates of 0.35, 0.48, the sixteenth point having x, y coordinates of 0.26, 0.50, the seventeenth point having x, y coordinates of 0.13, 0.26, the eighteenth point having x, y coordinates of 0.15, 0.20, and the nineteenth point having x, y coordinates of 0.26, 0.28, and (b) a second light source (or combination of light sources) that emits light having dominant wavelength in the range of from about 603 nm to about 800 nm or from about −495 nm to about −530 nm.

(5) There can be provided a lighting device that comprises (a) a first light source (or combination of light sources) that emits light that has x, y color coordinates (on a 1931 CIE Chromaticity Diagram) which define a point that is within a fifth area on the 1931 CIE Chromaticity Diagram enclosed by twentieth, twenty-first, twenty-second and twenty-third line segments, the twentieth line segment connecting a twentieth point to a twenty-first point, the twenty-first line segment connecting the twenty-first point to a twenty-second point, the twenty-second line segment connecting the twenty-second point to a twenty-third point, the twenty-third line segment connecting the twenty-third point to the twentieth point, the twentieth point having x, y coordinates of 0.21, 0.28, the twenty-first point having x, y coordinates of 0.26, 0.28, the twenty-second point having x, y coordinates of 0.32, 0.42, and the twenty-third point having x, y coordinates of 0.28, 0.44, and (b) a second light source (or combination of light sources) that emits light having dominant wavelength in the range of from about 603 nm to about 800 nm or from about −495 nm to about −530 nm.

(6) There can be provided a lighting device that comprises (a) a first light source (or combination of light sources) that emits light that has x, y color coordinates (on a 1931 CIE Chromaticity Diagram) which define a point that is within a sixth area on the 1931 CIE Chromaticity Diagram enclosed by twenty-twenty-seventh, twenty-fifth, twenty-sixth and twenty-seventh line segments, the twenty-fourth line segment connecting a twenty-fourth point to a twenty-fifth point, the twenty-fifth line segment connecting the twenty-fifth point to a twenty-sixth point, the twenty-sixth line segment connecting the twenty-sixth point to a twenty-seventh point, the twenty-seventh line segment connecting the twenty-seventh point to the twenty-fourth point, the twenty-fourth point having x, y coordinates of 0.30, 0.49, the twenty-fifth point having x, y coordinates of 0.35, 0.48, the twenty-sixth point having x, y coordinates of 0.32, 0.42, and the twenty-seventh point having x, y coordinates of 0.28, 0.44, and (h) a second light source (or combination of light sources) that emits light having dominant wavelength in the range of from about 603 nm to about 800 nm or from about −495 nm to about −530 nm.

Lighting devices according to the present inventive subject matter can further comprise elements that help to ensure that perceived hue (including color temperature) of light exiting the lighting device is accurate (e.g., within a specific tolerance). A wide variety of such elements and combinations of elements are known, and any of them can be employed in the lighting devices according to the present inventive subject matter.

Some embodiments of the present inventive subject matter, which can include or not include any of the features described elsewhere herein, can comprise one or more controllers configured to control a ratio of light emitted by at least a first light source and light emitted by at least a second light source such that a combination of the light is of a desired color point.

A controller may be a digital controller, an analog controller or a combination of digital and analog. For example, the controller may be an application specific integrated circuit (ASIC), a microprocessor, a microcontroller, a collection of discrete components or combinations thereof. In some embodiments, the controller may be programmed to control one or more light sources. In some embodiments, control of one or more light sources may be provided by the circuit design of the controller and is, therefore, fixed at the time of manufacture. In still further embodiments, aspects of the controller circuit, such as reference voltages, resistance values or the like, may be set at the time of manufacture so as to allow adjustment of the control of one or more light sources without the need for programming or control code.

Some embodiments in accordance with the present inventive subject matter (which can include or not include any of the features described elsewhere herein) can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to current adjusters, as described in U.S. patent application Ser. No. 12/117,280, filed May 8, 2008 (now U.S. Patent Publication No. 2008/0309255), the entirety of which is hereby incorporated by reference as if set forth in its entirety.

The light source(s) in lighting devices in accordance with the present inventive subject matter can be arranged and mounted in any suitable manner.

Some embodiments in accordance with the present inventive subject matter can comprise a support on which the light source (or the light sources, or at least one of the light sources) is mounted, and which is attached to the shield element.

Some embodiments in accordance with the present inventive subject matter (which can include or not include any of the features described elsewhere herein), can comprise a pedestal (or one or more pedestals) on which a shield element (or one or more shield elements) is supported. Such a pedestal, if included, can comprise any suitable material and can be in any suitable shape.

Some embodiments in accordance with the present inventive subject matter (which can include or not include any of the features described elsewhere herein), can comprise a pedestal (or one or more pedestals), and one or more openings, apertures or slots, etc. can extend through the pedestal in order to permit fluid to flow through the pedestal(s), e.g., from outside a space defined by portions of the shield element to inside the space.

Some embodiments in accordance with the present inventive subject matter (which can include or not include any of the features described elsewhere herein), can comprise a pedestal (or one or more pedestals), and there can be provided one or more post that extends from the pedestal (or from one or more of plural pedestals), and there can be provided one or more light sources mounted on the pedestal (e.g., any particular light source can be in direct contact with the pedestal or can be in indirect contact with the pedestal, e.g., a light source could be on a circuit board which is on a pedestal).

In some embodiments in accordance with the present inventive subject matter (which can include or not include any of the features described elsewhere herein) a pedestal and a post (or one or more pedestals and/or one or more posts) can be provided which have dimensions such that one or more light sources is/are at or near a center of a space within a shield element. In some of such embodiments, light can be directed above and below a plane (1) that is perpendicular to an axis of the post and (2) that extends through the light source (or through one or more of the light sources), and/or light sources can be mounted on a circuit board that is not flat (e.g., that defines more than half of a spherical shape) (or light sources can be mounted directly on a region of a post that is not flat (e.g., that defines more than half of a spherical shape), in order to simplify directing light in different directions (e.g., where light sources are light emitting diodes and the lighting device can be positioned so that some of the light emitting diodes are facing above horizontal (or upward) and some are facing below horizontal.

In some embodiments in accordance with the present inventive subject matter (which can include or not include any of the features described elsewhere herein) a pedestal and a post (or one or more pedestals and/or one or more posts) can be provided, where the pedestal and the post (or one or more pedestals and/or one or more posts) are separate elements that are joined together (e.g., welded or bolted together), or are respective regions of an integrally formed structure.

Some embodiments in accordance with the present inventive subject matter can include solid state light emitters that emit light of a first hue (e.g., light within a BSY range and solid state light emitters that emit light or a second hue (e.g., that is not within the BSY range, such as red or reddish or reddish orange or orangish, or orange light), where each of the solid state light emitters that emit light that is not BSY light is surrounded by five or six solid state light emitters that emit BSY light.

In some embodiments, solid state light emitters (including, e.g., a first group that emit light of a first hue (e.g., red, reddish, reddish-orange, orangish or orange light), and a second group that emit light of a second hue (e.g., BSY)) may be arranged pursuant to a guideline described below in paragraphs (1)-(5), or any combination of two or more thereof, to promote mixing of light from light sources emitting different colors of light:

(1) an array that has groups of first and second solid state light emitters with the first group of solid state light emitters arranged so that no two of the first group solid state light emitters are directly next to one another in the array;

(2) an array that comprises a first group of solid state light emitters and one or more additional groups of solid state light emitters, the first group of solid state light emitters being arranged so that at least three solid state light emitters from the one or more additional groups is adjacent each of the solid state light emitters in the first group;

(3) an array is mounted on a submount, and the array comprises a first group of solid state light emitters and one or more additional groups of solid state light emitters, and (c) the array is arranged so that less than fifty percent (50%), or as few as possible, of the solid state light emitters in the first group of solid state light emitters are on the perimeter of the array;

(4) an array comprises a first group of solid state light emitters and one or more additional groups of solid state light emitters, and the first group of solid state light emitters is arranged so that no two solid state light emitters from the first group are directly next to one another in the array, and so that at least three solid state light emitters from the one or more additional groups is adjacent each of the solid state light emitters in the first group; and/or (5) an array is arranged so that no two solid state light emitters from the first group are directly next to one another in the array, fewer than fifty percent (50%) of the solid state light emitters in the first group of solid state light emitters are on the perimeter of the array, and at least three solid state light emitters from the one or more additional groups is adjacent each of the solid state light emitters in the first group.

Arrays can also be arranged other ways, and can have additional features, that promote color mixing. In some embodiments, solid state light emitters can be arranged so that they are tightly packed, which can further promote natural color mixing.

If desired, some embodiments of lighting devices according to the present inventive subject matter can further comprise one or more active cooling elements, a wide variety of which are known to those skilled in the art, e.g., a fan, a piezoelectric device, a device comprising a magnetorestrictive material (e.g., MR, GMR, and/or HMR materials), or any other active cooling element as described in U.S. patent application Ser. No. 12/683,886, filed on Jan. 7, 2010 (now U.S. Patent Publication No. 2011/0089830), the entirety of which is hereby incorporated by reference as if set forth in its entirety. In devices according to the present inventive subject matter that include one or more active cooling elements, typically only enough air to break the boundary layer is required to induce temperature drops of 10 to 15 degrees C. (hence, in such cases, strong 'breezes" or a large fluid flow rate (large CFM) are typically not required).

Some embodiments of lighting devices in accordance with the present inventive subject matter have only passive cooling. On the other hand, some embodiments of lighting devices according to the present inventive subject matter have active cooling (and can optionally also have any of the passive cooling features described herein).

The expression "active cooling" is used herein in a manner that is consistent with its common usage to refer to cooling that is achieved through the use of some form of energy, as opposed to "passive cooling", which is achieved without the use of energy (i.e., while energy is supplied to one or more light sources, passive cooling is the cooling that would be achieved without the use of any component(s) that would require additional energy in order to function to provide additional cooling).

In embodiments where active cooling is provided, any type of active cooling can be employed, e.g., blowing or pushing (or assisting in blowing) an ambient fluid (such as air), thermoelectric cooling, phase change cooling (including supplying energy for pumping and/or compressing fluid), liquid cooling (including supplying energy for pumping, e.g., water, liquid nitrogen or liquid helium), magnetoresistance, etc.

In some embodiments where active cooling is provided, a given maximum junction temperature can be maintained while a larger magnitude of lumens can be provided (i.e, than would otherwise be the case if the active cooling were not provided). Alternatively, in some embodiments where active cooling is provided, a given magnitude of lumens can be maintained while a lower maximum junction temperature can be achieved (than would otherwise be the case if the active cooling were not provided). Alternatively, in some embodiments where active cooling is provided, a greater magnitude of lumens can be maintained (than would otherwise be the case if the active cooling were not provided), and/or a lower maximum junction temperature can be achieved (than would otherwise be the case if the active cooling were not provided).

In some embodiments where active cooling is provided, the option might exist to provide greater surface area for heat dissipation than might otherwise be desirable if the active cooling were not provided (and the increase in surface area might provide enhanced cooling capabilities). That is, in some embodiments of lighting devices according to the present inventive subject matter, decreasing the surface area of a vent (or the combined surface area of two or more vents) might constrict the flow path through the vent(s) enough that ambient medium would not flow through the vent(s), but if active cooling were included to assist in generating ambient medium flow, such flow would occur despite such constriction.

In some embodiments according to the present inventive subject matter that include one or more active cooling components, any of the one or more active cooling components can be in operation whenever the lighting device is being illuminated, or only during certain times when the lighting device is being illuminated. For example, in some of such embodiments: any of the one or more active cooling components can be energized intermittently (e.g., a set period of time on, followed by a set period of time off, etc.), any of the one or more active cooling components can be energized only when the lighting device is operating at a high lumen level, any of the one or more active cooling components can be energized only when a sensor detects high junction temperature, etc.). Moreover, the amount of cooling provided by the one or more active cooling components can be varied according to any suitable scheme, the energy supplied to one or more active cooling components can be adjusted based on a detected need for enhanced cooling, according to a set pattern, etc.

For example, a well known type of active cooling component is a fan. Persons of skill in the art are familiar with and have access to a wide variety of fans, and any of such devices can be employed as an active cooling component in lighting devices according to the present inventive subject matter. In general, fans operate by supplying energy to a motor which turns a rotor to which one or more fan blades are attached, so that the fan blades rotate about the rotor, the fan blades being shaped such that they push ambient fluid as they rotate. Turbines and compressors are other well known examples of active cooling components that function in a similar way.

Another example of a well known type of active cooling component is an electrostatic accelerator. Persons of skill in the art are familiar with and have access to a wide variety of electrostatic accelerators, and any of such devices can be employed as an active cooling component in lighting devices according to the present inventive subject matter. Electrostatic accelerators operate by generating ions at an electrode (the "corona electrode"), which ions are attracted (and, therefore, accelerated) toward another electrode (the "attracting electrode"). The ions impart momentum, directed toward the attracting electrode, to surrounding air molecules (or other ambient gas or gases) through collisions with such molecules. When the ions collide with other air molecules, not only do such ions impart momentum to such air molecules, but the ions also transfer some of their excess electric charge to these other air molecules, thereby creating additional molecules that are attracted toward the attracting electrode. These combined effects cause "electric wind" (also referred to as "corona wind"). The principle of ionic air propulsion with corona-generated charge particles has been known for many years. Efforts have been made to make these devices relatively quiet (they are sometimes referred to as "silent"). An example of an electrostatic fluid accelerator is the R5D5 device, developed at Purdue University by a founder of Thorm Micro Technologies with support from the National Science Foundation.

Another example of a well known type of active cooling component is a synthetic jet or pulsed air source. Persons of skill in the art are familiar with and have access to a variety of synthetic jets or pulsed air sources (e.g., devices marketed by Nuventix (www.nuventix.com) or Influent (www.influentmotion.com)), and any of such devices can be employed as an active cooling component in lighting devices according to the present inventive subject matter. For example, synthetic jets marketed by Nuventix as SynJet™ devices operate by periodic suction and ejection of fluid out of an orifice bounding a cavity by the time periodic motion of a diaphragm. During the ejection phase, a vortex, accompanied by a jet, is created and convected downstream from the jet exit. Once the vortex flow has propagated well downstream, ambient fluid from the vicinity of the orifice is entrained. The bulk of the high speed air (or other fluid) has moved away from the orifice, avoiding re-entrainment, while quiescent air (or other fluid) from around the orifice is sucked into the orifice. Thus, a synthetic jet is a "zero-mass-flux" jet comprised entirely of the ambient fluid, and can be conveniently integrated with, e.g., surfaces that require cooling without the need for complex plumbing. The time periodic motion of the diaphragm can be achieved using any of a variety of techniques, including piezoelectric, electromagnetic, electrostatic and combustion driven pistons. Synthetic jets can be used to create turbulent, pulsated air-jets that can be directed precisely to location where thermal management is needed.

Another example of a well known type of active cooling component is a piezoelectric fan. Persons of skill in the art are familiar with and have access to a wide variety of piezoelectric fans, and any of such devices can be employed as an active cooling component in lighting devices according to the present inventive subject matter. Piezoelectric fans generally have at least a piezoelectric element and a fan element, in which at least one dimension of the piezoelectric element changes when it is stressed electrically by a voltage, and the dimensional change causes the fan element to bend.

As mentioned above, another example of a well known type of active cooling is achieved using magnetoresistance (e.g., high-field magnetoresistance (HMR), giant magnetoresistance (GMR) or colossal magnetoresistance). Persons of skill in the art are familiar with and have access to a wide variety of devices that can use magnetoresistance to provide cooling, and any of such devices can be employed as an active cooling component in lighting devices according to the present inventive subject matter.

As noted above, another example of a well known type of cooling is thermoelectric cooling. Persons of skill in the art are familiar with and have access to a wide variety of devices that can achieve thermoelectric cooling (also known as the Peltier effect), and any of such devices can be employed as an active cooling component in lighting devices according to the present inventive subject matter. Whenever an electric voltage difference is applied to two dissimilar metals that form a junction, a temperature differential is created. The direction of heat transfer is determined by the polarity of the current (if the polarity were reversed, the direction of heat transfer would also be reversed). Devices that operate on this principle to provide cooling are referred to as Peltier coolers or as thermoelectric coolers.

As noted above, another example of a well known type of cooling is phase change cooling. Persons of skill in the art are familiar with and have access to a wide variety of devices that can achieve phase change cooling (e.g., heat pipes, refrigeration devices, etc.), and any of such devices can be employed as an active cooling component in lighting devices according to the present inventive subject matter.

As noted above, another example of a well known type of cooling is liquid cooling (including supplying energy for pumping fluid material, e.g., water, liquid nitrogen or liquid helium). Persons of skill in the art are familiar with and have access to a wide variety of devices that can achieve liquid cooling, and any of such devices can be employed as an active cooling component in lighting devices according to the present inventive subject matter.

In embodiments that include one or more active cooling device(s), electricity can be supplied to the active cooling device from the same energy source from which energy is supplied to the one or more light source(s), or some or all of the electricity supplied to the active cooling device can be supplied from some other energy source. For instance, in some embodiments, an active cooling device (or devices) can be supplied with electricity directly from the lighting device input voltage without the need for a separate driver.

In embodiments that include one or more active cooling devices, the active cooling device (or each of the devices) can be located in any suitable location (or locations). For instance, in embodiments that include one or more active cooling devices that move ambient fluid (e.g., air), the active cooling device (or devices) can be placed in any suitable location, e.g., just upstream from the light source(s), just downstream of the light source(s), or in any other suitable location.

Some embodiments in accordance with the present inventive subject matter can further comprise one or more printed circuit boards, on which one or more light sources (e.g., one or more solid state light emitters) can be mounted. Persons of skill in the art are familiar with a wide variety of circuit boards, and any such circuit boards can be employed in the lighting devices according to the present inventive subject matter. One representative example of a circuit board with a relatively high heat conductivity is a metal core printed circuit board.

In some embodiments, lighting devices according to the present inventive subject matter are capable of dissipating over 30 W worth of heat without any active cooling elements.

Lighting devices according to the present inventive subject matter can comprise one or more light sources that emit light in any suitable pattern (e.g., in the form of a flood light, a spotlight, a downlight, etc.).

In some aspects of the present inventive subject matter, there are provided lighting devices that provide lumen output of at least 600 lumens, and in some embodiments at least 750 lumens, at least 900 lumens, at least 1000 lumens, at least 1100 lumens, at least 1200 lumens, at least 1300 lumens, at least 1400 lumens, at least 1500 lumens, at least 1600 lumens, at least 1700 lumens, at least 1800 lumens (or in some cases at least even higher lumen outputs, such as at least 2000 lumens, at least 3000 lumens, at least 4000 lumens or more), and/or CRI Ra of at least 70 (and in some embodiments at least 80, at least 85, at least 90 or at least 95).

Lighting devices in accordance with the present inventive subject matter can emit light of generally any desired CCT or within any desired range of CCT. In some embodiments, there are provided lighting devices that emit light having a correlated color temperature (CCT) of between about 1500K and about 2500K, between about 2500K and about 4000K, between about 4000K and about 6500K, between about 6500K and about 10,000K, between about 1500K and about 4000K, between about 2500K and about 6500K, between about 4000K and about 10,000K, between about 1500K and about 6500K, between about 2500K and about 10,000K, between about 1500K and about 10,000K, etc. In some embodiments, the CCT may be as defined in the Energy Star Requirements for Solid State Luminaires, Version 1.1, promulgated by the United States Department of Energy.

The lighting devices according to the present inventive subject matter can be any suitable shape and size. For example, a lighting device according to the present inventive subject matter can fit within the envelope for any conventional lighting device, e.g., A lamps (i.e., which meets the dimensional constraints for a lamp to be characterized as an A lamp), 9-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, T lamps, Linestra 2-base lamps, AR lamps, ED lamps, E lamps, BT lamps, Linear fluorescent lamps, U-shape fluorescent lamps, circline fluorescent lamps, single twin tube compact fluorescent lamps, double twin tube compact fluorescent lamps, triple twin tube compact fluorescent lamps, A-line compact fluorescent lamps, screw twist compact fluorescent lamps, globe screw base compact fluorescent lamps, reflector screw base compact fluorescent lamps, etc., or any other conventional lighting device, or any other shape and size. Alternatively, the lamps can be of any suitable shape and size that does not conform to any of the types described above in this paragraph.

In some embodiments according to the present inventive subject matter, which can include or not include any of the features described elsewhere herein, the lighting device is an A lamp (i.e., it meets the dimensional constraints for a lighting device to be characterized as an A lamp). An infinite number of varieties of lighting devices can be provided that fall within the definition of A lamps. For example, a number of different varieties of conventional A lamps exist and include those identified as A 15 lamps, A 17 lamps, A 19 lamps, A 21 lamps and A 23 lamps. The expression "A lamp" as used herein includes any lighting device that satisfies the dimensional characteristics for A lamps as defined in ANSI C78.20-2003, including the conventional A lamps identified in the preceding sentence. The lighting devices according to the present inventive subject matter can satisfy (or not satisfy) any or all of the other characteristics for A lamps (defined in ANSI C78.20-2003).

Lighting devices according to some embodiments of the present inventive subject matter provide an expected L70 lifetime of at least 25,000 hours. Lighting devices according to some embodiments of the present inventive subject matter provide expected L70 lifetimes of at least 35,000 hours, and lighting devices according to some embodiments of the present inventive subject matter provide expected L70 lifetimes of at least 50,000 hours.

In many situations, the lifetime of light sources, e.g., solid state light emitters, can be correlated to a thermal equilibrium temperature (e.g., junction temperatures of solid state light emitters).

The expression "after thermal equilibrium has been reached" refers to supplying current to one or more light sources in a lighting device to allow the light source(s) and other surrounding structures to heat up to (or near to) a temperature to which they will typically be heated when the lighting device is illuminated. The particular duration that current should be supplied will depend on the particular configuration of the lighting device. For example, the greater the thermal mass, the longer it will take for the light source(s) to approach their thermal equilibrium operating temperature. While a specific time for operating the lighting device prior to reaching thermal equilibrium may be lighting device-specific, in some embodiments, durations of from about 1 to about 60 minutes or more and, in specific embodiments, about 30 minutes, may be used. In some instances, thermal equilibrium is reached when the temperature of the light source (or each of the light sources) does not vary substantially (e.g., more than 2 degrees C.) without a change in ambient or operating conditions.

The correlation between lifetime and junction temperature may differ based on the manufacturer (e.g., in the case of solid state light emitters, Cree, Inc., Philips-Lumileds, Nichia, etc). The lifetimes are typically rated as thousands of hours at a particular temperature (junction temperature in the case of solid state light emitters). Thus, in particular embodiments, the component or components of the thermal management system of the lighting device is/are selected so as to extract heat from the light source(s) and dissipate the extracted heat to a surrounding environment at such a rate that a temperature is maintained at or below a particular temperature (e.g., to maintain a junction temperature of a solid state light emitter at or below a 25,000 hour rated lifetime junction temperature for the solid state light source in a 25° C. surrounding environment, in some embodiments, at or below a 35,000 hour rated lifetime junction temperature, in further embodiments, at or below a 50,000 hour rated lifetime junction temperature, or other hour values, or in other embodiments, analogous hour ratings where the surrounding temperature is 35° C. (or any other value).

In some aspects of the present inventive subject matter, there is provided a lighting device that can be easily substituted (i.e., retrofitted or used in place of initially) for a conventional lamp (e.g., an incandescent lamp, a fluorescent lamp or other conventional types of lamps, including lamps that include solid state light emitters). For example, some embodiments of lighting devices in accordance with the present inventive subject matter can be engaged with the same socket that a conventional lamp is engaged (a representative example of retrofitting being simply unscrewing an incandescent lamp from an Edison socket and threading in the Edison socket, in place of the incandescent lamp, a lighting device in accordance with the present inventive subject matter that comprises one or more solid state light emitters).

In some aspects of the present inventive subject matter, there are provided lighting devices that provide good efficiency and/or that are within the size and shape constraints of the lamp for which the lighting device is a replacement.

In some aspects of the present inventive subject matter, which can include or not include any of the features described elsewhere herein, there are provided lighting devices that provide sufficient lumen output (to be useful as a replacement for a conventional lamp), that provide good efficiency and that are within the size and shape constraints of the lamp for which the lighting device is a replacement. In some cases, "sufficient lumen output" means at least 75% of the lumen output of the lamp for which the lighting device is a replacement, and in some cases, at least 85%, 90%, 95%, 100%, 105%, 110%, 115%, 120% or 125% of the lumen output of the lamp for which the lighting device is a replacement.

In some aspects of the present inventive subject matter, which can include or not include any of the features described elsewhere herein, there are provided lighting devices that emit light in a desired range of directions, e.g., substantially omnidirectionally or in some other desired pattern.

In some embodiments in accordance with the present inventive subject matter, the lighting device can emit light in all directions, while in other embodiments, the lighting device can emit light in fewer than all directions (as a result of the shape of the lighting device and/or the nature of the lighting device, and/or as a result of a shade positioned relative to the lighting device, and/or as a result of some other angular control of the light emanating from the lighting device).

In some embodiments according to the present inventive subject matter, including some embodiments that include or do not include any of the features as discussed above, a lighting device further comprises circuitry that delivers current from at least one energy source to at least one light source to enable illumination of the light source(s).

In some lighting devices according to the present inventive subject matter, there are further included one or more circuitry components, e.g., one or more power supply components and/or one or more drive components for supplying and controlling current supplied to one or more light sources. Persons of skill in the art are familiar with a wide variety of ways to supply and control the current supplied to light sources, and any such ways can be employed in the devices of the present inventive subject matter. For example, such circuitry can include at least one contact, at least one leadframe, at least one current regulator, at least one power control, at least one voltage control, at least one boost, at least one capacitor and/or at least one bridge rectifier, persons of skill in the art being familiar with such components and being readily able to design appropriate circuitry to meet whatever current flow characteristics are desired.

In some embodiments in accordance with the present inventive subject matter that comprise a power supply, a power supply can comprise any electronic components that are suitable for a lighting device, for example, any of (1) one or more electrical components employed in converting electrical power (e.g., from AC to DC and/or from one voltage to another voltage), (2) one or more electronic components employed in driving one or more light source, e.g., running one or more light source intermittently and/or adjusting the current supplied to one or more light sources in response to a user command, a detected change in intensity or color of light output, a detected change in an ambient characteristic such as temperature or background light, etc., and/or a signal contained in the input power (e.g., a dimming signal in AC power supplied to the lighting device), etc., (3) one or more circuit boards (e.g., a metal core circuit board) for supporting and/or providing current to any electrical components, and/or (4) one or more wires connecting any components (e.g., connecting an Edison socket to a circuit board), etc., e.g. electronic components such as linear current regulated supplies, pulse width modulated current and/or voltage regulated supplies, bridge rectifiers, transformers, power factor controllers etc.

Many different techniques have been described for driving light sources in many different applications, including, for example, those described in U.S. Pat. No. 3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Berg-johansen, U.S. Pat. No. 7,202,608 to Robinson et al, U.S. Pat. Nos. 6,995,518, 6,724,376, 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

Energy can be supplied to the at least one light source from any source or combination of sources, for example, the grid (e.g., line voltage), one or more batteries, one or more photovoltaic energy collection devices (i.e., a device that includes one or more photovoltaic cells that convert energy from the sun into electrical energy), one or more windmills, etc.

Respective light sources or groups of light sources can be electrically connected in any suitable pattern, e.g., in parallel, in series, in series parallel (e.g., in a series of subsets, each subset comprising two or more (e.g., three) light sources arranged in parallel), in a single string or in two or more strings, etc.

In some embodiments of the present inventive subject matter, including some embodiments that include or do not include any of the features as discussed herein, a set of parallel solid state light emitter strings (i.e., two or more strings of solid state light emitters arranged in parallel with each other) is arranged in series with a power line, such that current is supplied through the power line to each of the respective strings of solid state light emitters. The expression "string", as used herein, means that at least two solid state light emitters are electrically connected in series. In some such embodiments, the relative quantities of solid state light emitters that emit light of different respective hues differ from one string to the next, e.g., a first string contains a first percentage of solid state light emitters that emit light within a first hue and/or wavelength range (e.g., dominant wavelength of 400 nm to 480 nm, optionally packaged with luminescent material that emits light of dominant wavelength in a third wavelength range, e.g., 500 nm to 585 nm) and a second percentage of solid state light emitters that emit light within a second hue and/or wavelength range (e.g., dominant wavelength of 600 nm to 640 nm), and a second string contains a third percentage (different from the first percentage) of solid state light emitters that emit light within the first wavelength range and/or hue and a fourth percentage of solid state light emitters that emit light within the second wavelength range and/or hue. As a representative example, first and second strings each contain solely (i.e., 100%) 400 nm to 480 nm dominant wavelength solid state light emitters (optionally packaged with luminescent material that emits light of dominant wavelength in a third wavelength range, e.g., 500 nm to 585 nm), and a third string contains 50% 400 nm to 480 nm dominant wavelength solid state light emitters and 50% 600 nm to 640 nm dominant wavelength solid state light emitters (each of the three strings being electrically connected in parallel to each other and in series with a common power line). By doing so, it is possible to easily adjust the relative intensities of the light of the respective wavelengths, and thereby effectively navigate within the CIE Diagram and/or compensate for other changes. For example, the brightness of red light can be increased, when necessary, in order to compensate for any reduction of the brightness of the light generated by the 600 nm to 640 nm dominant wavelength solid state light emitters. Thus, for instance, in the representative example described above, by increasing or decreasing the current supplied to the third power line, and/or by increasing or decreasing the current supplied to the first power line and/or the second power line (and/or by intermittently interrupting the supply of power to the first power line or the second power line), the x, y coordinates of the mixture of light emitted from the lighting device can be appropriately adjusted.

Some embodiments in accordance with the present inventive subject matter employ one or more current adjuster(s) that adjusts the current supplied to one or more other components, e.g., one or more strings of solid state light emitters. In such embodiments, the current adjuster, when adjusted, adjusts the current supplied to such component(s).

For example, in some embodiments, a current adjuster is directly or switchably electrically connected to at least one string of solid state light emitters, and in other embodiments, a plurality of current adjusters are each directly or switchably electrically connected to a respective string of solid state light emitters (or strings of solid state light emitters).

Some embodiments in accordance with the present inventive subject matter employ circuitry by which one or more light sources can be bypassed (permanently or intermittently) to achieve or contribute to color output adjustment.

Persons of skill in the art are familiar with, and have ready access to, a variety of current adjusters, and any of such current adjusters can be employed in embodiments in accordance with the present inventive subject matter.

In some embodiments of the present inventive subject matter, there are further provided one or more switches electrically connected to one or more respective strings of light sources, whereby the switch selectively switches on and off current to the light source(s) on the respective string.

Lighting devices in accordance with the present inventive subject matter can comprise one or more components or circuits to provide dimming. Persons of skill in the art are familiar with a variety of components and combinations of components that can be used in a range of ways to provide dimming, as desired.

The lighting devices according to the present inventive subject matter can further comprise any suitable electrical connector, a wide variety of which are familiar to those of skill in the art, e.g., an Edison connector (for insertion in an Edison socket), a GU24 connector, etc., or may be directly wired to an electrical branch circuit.

In some embodiments in accordance with the present inventive subject matter, there are provided lighting devices that provide a wall plug efficiency of at least 60 lumens per watt, and in some embodiments, at least 70 lumens per watt, at least 80 lumens per watt, at least 90 lumens per watt, at least 95 lumens per watt, at least 100 lumens per watt or at least 104 lumens per watt.

The expression "wall plug efficiency", as used herein, is measured in lumens per watt, and means lumens exiting a lighting device, divided by all energy supplied to create the light, as opposed to values for individual components and/or assemblies of components. Accordingly, wall plug efficiency, as used herein, accounts for all losses, including, among others, any quantum losses, i.e., losses generated in converting line voltage into current supplied to light emitters, the ratio of the number of photons emitted by luminescent material(s) divided by the number of photons absorbed by the luminescent material(s), any Stokes losses, i.e., losses due to the change in frequency involved in the absorption of light and the re-emission of visible light (e.g., by luminescent material(s)), and any optical losses involved in the light emitted by a component of the lighting device actually exiting the lighting device. In some embodiments, the lighting devices in accordance with the present inventive subject matter provide the wall plug efficiencies specified herein when they are supplied with AC power (i.e., where the AC power is converted to DC power before being supplied to some or all components, the lighting device also experiences losses from such conversion), e.g., AC line voltage. The expression "line voltage" is used in accordance with its well known usage to refer to electricity supplied by an energy source, e.g., electricity supplied from a grid, including AC and DC.

As noted above, in some embodiments in accordance with the present inventive subject matter, which can include or not include, as suitable, any of the other features described herein, the lighting device can further comprise a mixing chamber, and/or a housing and/or a fixture (which may, if desired, comprise one or more accessories, e.g., a trim element, a shade, an eyeball trim, etc.). A mixing chamber, and/or a housing and/or a fixture (if included) can generally be of any suitable shape and size, and can be made out of any suitable material or materials. Representative examples of materials that can be used in making a mixing chamber and/or a housing and/or a fixture include, among a wide variety of other materials, extruded aluminum, powder metallurgy formed aluminum, die cast aluminum, liquid crystal polymer, polyphenylene sulfide (PPS), thermoset bulk molded compound or other composite material. In some embodiments that include a mixing chamber element, the mixing chamber element can consist of or can comprise a reflective element (and/or one or more of its surfaces can be reflective). Such reflective elements (and surfaces) are well known and readily available to persons skilled in the art. A representative example of a suitable material out of which a reflective element can be made is a material marketed by Furukawa (a Japanese corporation) under the trademark MCPET®. In some embodiments in accordance with the present inventive subject matter, which can include or not include, as suitable, any of the other features described herein, a housing and/or a fixture (if included) can comprise a material that can be molded and/or shaped, and/or it can comprise a material that is an effective heat sink (i.e., which has high thermal conductivity and/or high heat capacity).

Some embodiments of lighting devices in accordance with the present inventive subject matter (which can include or not include any of the features described elsewhere herein) include one or more lenses, diffusers, obscuration elements or light control elements. Persons of skill in the art are familiar with a wide variety of lenses, diffusers, obscuration elements and light control elements, can readily envision a variety of materials out of which a lens, a diffuser, an obscuration element or a light control element can be made (e.g., polycarbonate materials, acrylic materials, fused silica, polystyrene, etc.), and are familiar with and/or can envision a wide variety of shapes that lenses, diffusers, obscuration elements and light control elements can be. Any of such materials and/or shapes can be employed in a lens and/or a diffuser and/or an obscuration element and/or a light control element in an embodiment that includes a lens and/or a diffuser and/or an obscuration element and/or a light control element. As will be understood by persons skilled in the art, a lens or a diffuser or an obscuration element or a light control element in a lighting device according to the present inventive subject matter can be selected to have any desired effect on incident light (or no effect), such as focusing, diffusing, etc. Any such lens and/or diffuser and/or obscuration element and/or light control element can comprise one or more luminescent materials, e.g., one or more phosphor.

In embodiments in accordance with the present inventive subject matter that include a lens (or plural lenses), the lens (or lenses) can be positioned in any suitable location and orientation.

In embodiments in accordance with the present inventive subject matter that include a diffuser (or plural diffusers), the diffuser (or diffusers) can be positioned in any suitable location and orientation. In some embodiments, which can include or not include any of the features described elsewhere herein, a diffuser can be provided over a top or any other part of a lighting device, and the diffuser can comprise one or more luminescent material (e.g., in particulate form) spread throughout a portion of the diffuser or an entirety of the diffuser.

In embodiments in accordance with the present inventive subject matter that include an obscuration element (or plural obscuration elements), the obscuration element (or obscuration elements) can be positioned in any suitable location and orientation.

In embodiments in accordance with the present inventive subject matter that include a light control element (or plural light control elements), the light control element (or light control elements) can be positioned in any suitable location and orientation. Persons of skill in the art are familiar with a variety of light control elements, and any of such light control elements can be employed.

In some embodiments according to the present invention, two or more types of features can be provided in a single element. For example, a single structure can provide light control as well as diffusion and/or obscuration. Typically, where multiple types of features are provided in a single structure, different regions of the structure provide the different features, e.g., regions providing the different features are stacked on one another.

In addition, one or more scattering elements (e.g., layers) can optionally be included in lighting devices according to the present inventive subject matter. For example, a scattering element can be included in a lumiphor, and/or a separate scattering element can be provided. A wide variety of separate scattering elements and combined luminescent and scattering elements are well known to those of skill in the art, and any such elements can be employed in lighting devices in accordance with the present inventive subject matter.

In addition, one or more light output shaping elements can be employed in some embodiments in accordance with the present inventive subject matter, persons of skill in the art being familiar with a variety of suitable light output shaping elements.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated, in some instances, with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

FIG. 1 illustrates a shield element 10 in accordance with the present inventive subject matter. Referring to FIG. 1, the shield element 10 comprises a plurality of vents 11 through which fluid (i.e., gas and/or liquid) can pass. FIG. 1 is a top perspective view of the shield element 10.

Figure 2:
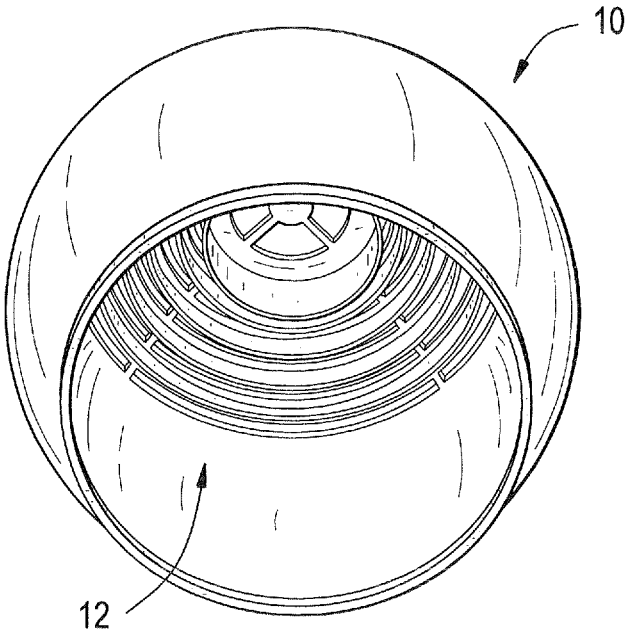
FIG. 2 is a bottom perspective view of the shield element 10.

FIG. 2 is a bottom perspective view of the shield element 10. A space 12, defined by portions of the shield element 10, is visible in FIG. 2.

Figure 3:
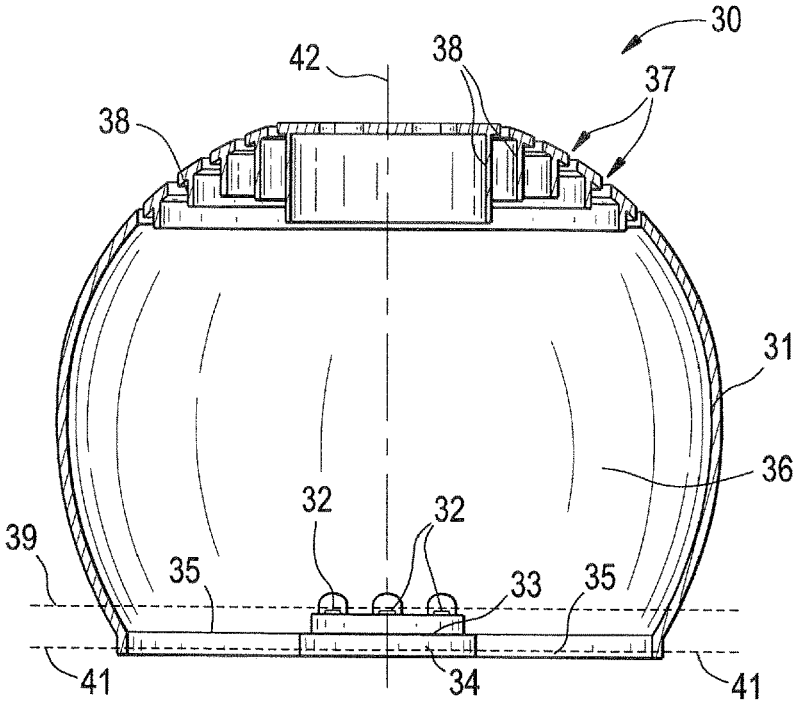
FIG. 3 is a sectional view that illustrates a lighting device 30 in accordance with the present inventive subject matter.

FIG. 3 is a sectional view that illustrates a lighting device 30 in accordance with the present inventive subject matter. Referring to FIG. 3, the lighting device 30 comprises a shield element 31 and a plurality of light sources 32. The light sources 32 are LEDs that are mounted on a circuit board 33. The circuit board 33 is mounted on a support 34 which is held in place relative to the shield element 31 by a plurality of legs 35 (only two of which are visible in FIG. 3).

Portions of the shield element 31 define a space 36. The shield element 31 comprises a plurality of vents 37 through which fluid can exit the space 36. The shield element 31 also comprises a plurality of shield members 38 which assist in shielding the light sources 32 from potential lines of vision through the vents 37. The shield element 31 is substantially transparent.

As can be seen in FIG. 3, the light sources 32 are within the space 36. The shield element 31 blocks the light sources 32 from direct view from all locations outside the shield element that are above (in the orientation depicted in FIG. 3) a plane 39 that extends through the light sources 32. The plane 39 is also an emission plane of each of the light sources 32.

Outer surfaces of the shield element 31 correspond to portions of a shape of an A lamp.

Figure 4:
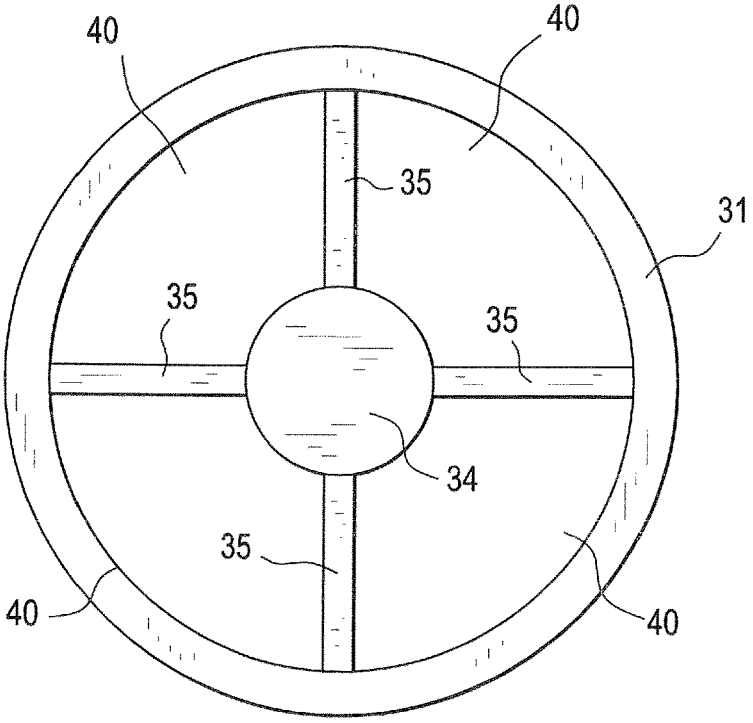
FIG. 4 is a bottom view of a bottommost portion of the lighting device 30.

FIG. 4 is a bottom view of a bottommost portion of the lighting device 30. The bottom portion of the shield element 31 defines an opening 40 (which is divided by the legs 35 and the support 34 into four sections). In some instances, air can enter the space 36 through the opening 40, absorb heat from the light sources 32, and exit the space 36 through one or more of the vents 37. In this embodiment, the space 36 can be thought of as also being defined by portions of the shield element 31 and by the opening 40.

The shield element 31 can also be thought of as blocking the light sources 32 from direct view from all locations outside the shield element that are above (in the orientation depicted in FIG. 3) a plane 41 defined by the opening 40. In this embodiment, the plane 41 is substantially parallel to the emission planes of each of the light sources 32.

Each of the vents 37 comprises four vent portions, and each of the vents 37 is substantially symmetrical with respect to an axis 42.

Figure 5:
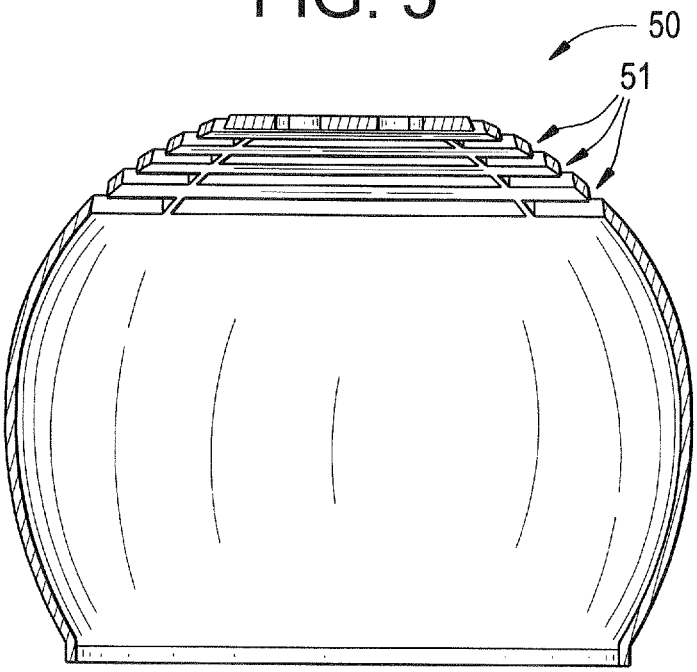
FIG. 5 is a sectional view that illustrates a shield element 50 in accordance with the present inventive subject matter.

FIG. 5 is a sectional view that illustrates a shield element 50 in accordance with the present inventive subject matter. Referring to FIG. 5, the shield element 50 comprises a plurality of vents 51 through which fluid can pass.

Figure 6:
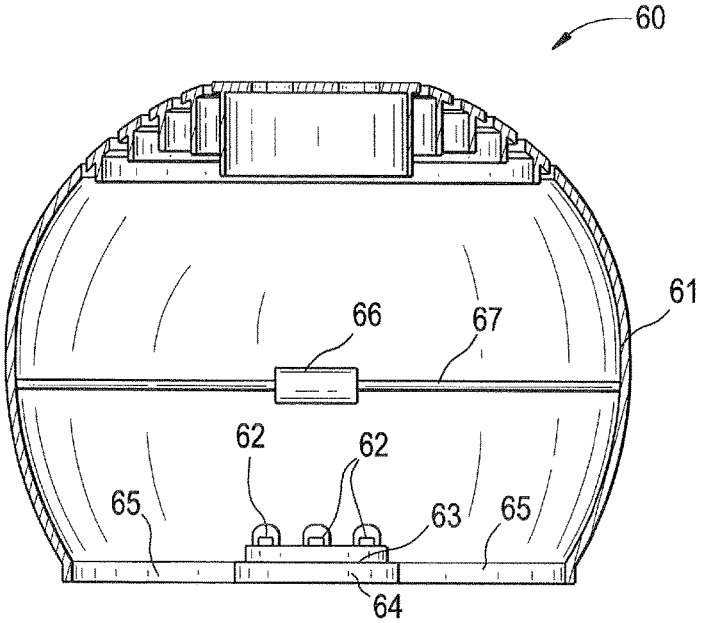
FIG. 6 is a sectional view that illustrates a lighting device 60 in accordance with the present inventive subject matter.

FIG. 6 is a sectional view that illustrates a lighting device 60 in accordance with the present inventive subject matter. Referring to FIG. 6, the lighting device 60 comprises a shield element 61 and a plurality of light sources 62. The light sources 62 are LEDs that are mounted on a circuit board 63. The circuit board 63 is mounted on a support 64 which is held in place relative to the shield element 61 by a plurality of legs 65 (only two of which are visible in FIG. 6).

The lighting device 60 further comprises an active cooling element 66, supported by a plurality of legs 67 (only two of which are visible in FIG. 6).

Figure 7:
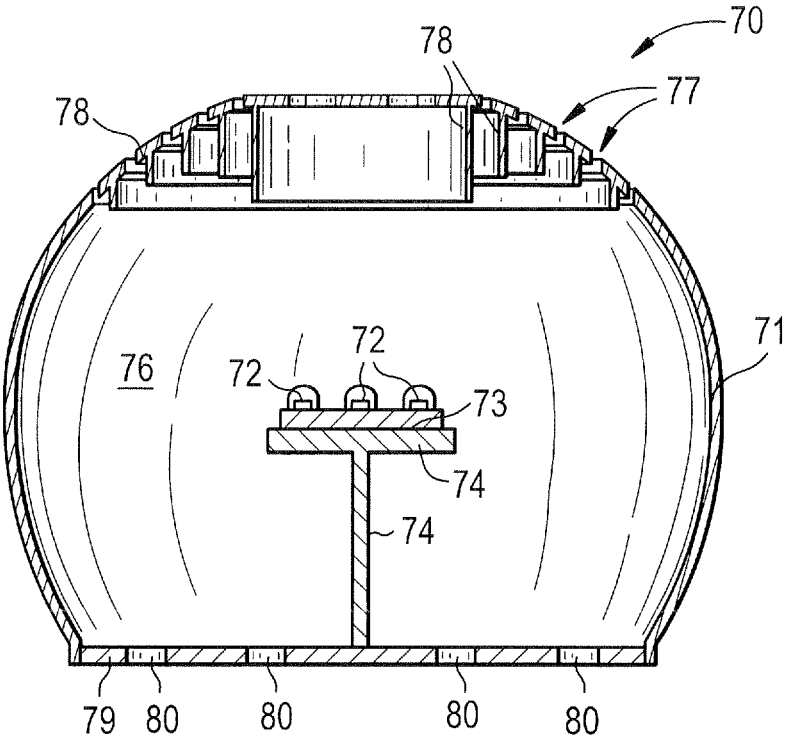
FIG. 7 is a sectional view that illustrates a lighting device 70 in accordance with the present inventive subject matter.

FIG. 7 is a sectional view that illustrates a lighting device 70 in accordance with the present inventive subject matter. Referring to FIG. 7, the lighting device 70 comprises a shield element 71 and a plurality of light sources 72. The light sources 72 are LEDs that are mounted on a circuit board 73. The circuit board 73 is mounted on a post 74. The post 74 and the shield element 71 are supported by a pedestal 79. A plurality of apertures 80 extend through the pedestal 79.

Portions of the shield element 71 define a space 76. The shield element 71 comprises a plurality of vents 77. Fluid in the space 76 (e.g., air) absorbs heat generated by the light sources 72, causing the fluid to rise and exit the space 76 through vents 77, thereby causing air to enter the space 76 through the apertures 80, thereby creating convective air flow. The shield element 71 comprises a plurality of shield members 78 which assist in shielding the light sources 72 from potential lines of vision through the vents 77. The shield element 71 is substantially transparent.

Figure 8:
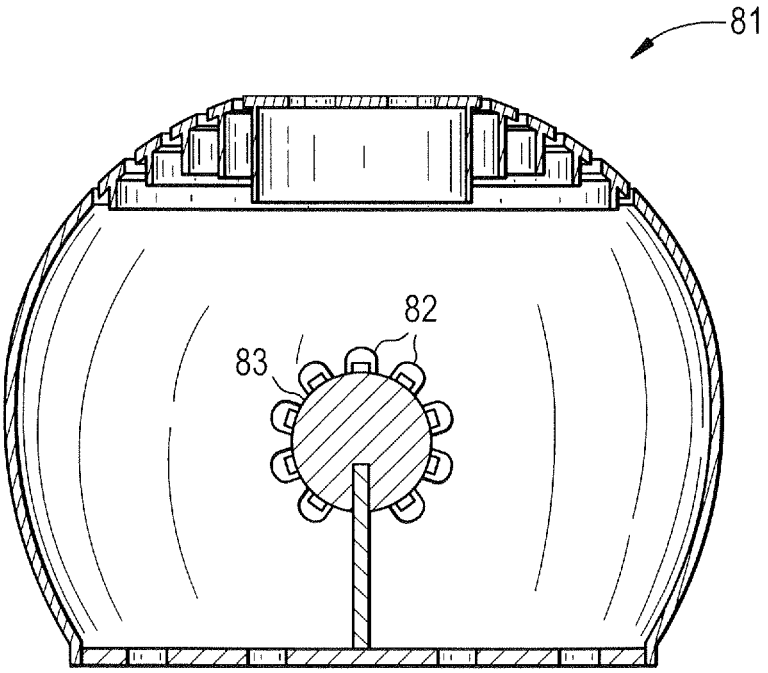
FIG. 8 is a sectional view that illustrates a lighting device 80 in accordance with the present inventive subject matter.

FIG. 8 is a sectional view that illustrates a lighting device 81 in accordance with the present inventive subject matter. The lighting device 81 is similar to the lighting device 70 depicted in FIG. 7, except that the lighting device 81 comprises a circuit board 83 that is not flat, and that defines more than half of a spherical shape, so that some of the light sources 82 (which are light emitting diodes in this embodiment) face above horizontal and some face below horizontal (when the lighting device 81 is in the orientation shown in FIG. 8).

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices and shield elements described herein can be integrated. Any structural part of the lighting devices and shield elements described herein can be provided in two or more parts (which may be held together in any known way, e.g., with adhesive, screws, bolts, rivets, staples, etc.). Similarly, any two or more functions can be conducted simultaneously, and/or any function can be conducted in a series of steps.

The invention claimed is:

1. A lighting device, comprising:
a shield element; and
at least a first light source,
the first light source within a space defined by portions of the shield element,
the shield element comprising at least a first vent through which gas can pass to exit from the space,
the shield element blocking the first light source from direct view from at least all locations outside the shield element that are to a light emission side of an emission plane of the first light source, the emission plane extending through the first light source,
the first vent to the light emission side of the emission plane,
the emission plane and the vent on opposite sides of the space.

2. A lighting device as recited in claim 1, wherein outer surfaces of the shield element correspond to portions of a shape of an A lamp.

3. A lighting device as recited in claim 1, wherein at least part of the shield element is substantially transparent.

4. A lighting device as recited in claim 1, wherein the first light source is a solid state light emitter.

5. A lighting device as recited in claim 1, wherein the first light source is a light emitting diode.

6. A lighting device as recited in claim 1, wherein the lighting device further comprises at least one active cooling element.

7. A lighting device, comprising
a shield element;
at least a first light source; and
a support,
the first light source on the support,
the shield element comprising regions that define an opening,
the shield element comprising at least a first vent,
the first light source within a space completely defined by the opening, the support, the shield element and the at least a first vent,
gas within the space can pass through the first vent to exit from the space,
the shield element blocking the first light source from direct view from at least all locations outside the shield element that are to a light emission side of an emission plane of the first light source,
an entirety of the space to the light emission side of the emission plane,
the first vent to the light emission side of the plane.

8. A lighting device as recited in claim 7, wherein a substantial entirety of a periphery of the opening is parallel to the plane.

9. A lighting device as recited in claim 7, wherein outer surfaces of the shield element correspond to portions of a shape of an A lamp.

10. A lighting device as recited in claim 7, wherein at least part of the shield element is substantially transparent.

11. A lighting device as recited in claim 7, wherein the first light source is a solid state light emitter.

12. A lighting device as recited in claim 7, wherein the first light source is a light emitting diode.

13. A lighting device as recited in claim 7, wherein the plane defined by at least portions of the opening is substantially parallel to an emission plane of the first light source.

14. A lighting device as recited in claim 7, wherein the lighting device further comprises at least one active cooling element.

15. A shield element, comprising:
shield element regions that define a space; and
at least a first vent through which gas can pass to exit from the space,
the shield element blocking at least a first location within the space from direct view from at least all locations outside the shield element that are to a first side of a first plane, the first plane perpendicular to an axis of the shield element, and the first plane extending through the first location,
the first vent to the first side of the first plane,
the shield element configured to allow at least some light emitted from the first location to pass directly through the first vent and the shield element.

16. A shield element as recited in claim 15, wherein:
the shield element further comprises at least a second vent,
the first vent comprises at least first and second vent portions, and
the second vent comprises at least third and fourth vent portions.

17. A shield element as recited in claim 15, wherein outer surfaces of the shield element correspond to portions of a shape of an A lamp.

18. A shield element as recited in claim 15, wherein at least part of the shield element is substantially transparent.

19. A lighting device, comprising:
a shield element; and
at least a first light source,
the first light source within a space defined by portions of the shield element,
the shield element comprising at least one vent through which gas can pass to exit from the space,
the shield element blocking the first light source from direct view from at least all locations outside the shield element that are to a first side of an emission plane of the first light source, the emission plane extending through the first light source,
an entirety of the space to the first side of the emission plane.

20. A lighting device, comprising
a shield element; and
at least a first light source,
the shield element comprising regions that define an opening,
the first light source within a space defined by portions of the shield element and the opening,
the shield element comprising at least one vent through which gas can pass to exit from the space,
the shield element blocking the first light source from direct view from at least all locations outside the shield element that are to a first side of a plane defined by at least portions of the opening,
an entirety of the space to the first side of the plane,
the plane and the vent on opposite sides of the space.

21. A lighting device, comprising:
a shield element; and
at least a first light source,
the first light source within a space defined by portions of the shield element,
the shield element comprising at least a first vent through which gas can pass to exit from the space,
the light source shielded from direct view through the vent from a position outside the space by at least a portion of the shield element,
an entirety of the space to an emission side of an emission plane of the first light source.

22. A lighting device, comprising:
a shield element; and
at least a first light source,
the first light source within a space defined by portions of the shield element,
the shield element comprising at least a first shield member and at least a first vent through which gas can pass to exit from the space,
at least some light directly from the light source passing through the first shield member and the first vent.

23. A lighting device, comprising:
a shield element; and
at least a first light source,
the first light source within a space defined by portions of the shield element,
the shield element comprising at least a first shield member and at least a first vent through which gas can pass to exit from the space,
the first shield member blocking the first light source from direct view through the first vent,
an entirety of the space to an emission side of an emission plane of the first light source.

24. A lighting device, comprising:
a shield element; and
at least a first light source,
the first light source within a space defined by portions of the shield element,
the shield element comprising at least a first shield member and at least a first vent through which gas can pass to exit from the space,
the first vent substantially symmetrical with respect to an axis of the lighting device,
an entirety of the space to an emission side of an emission plane of the first light source.

25. A lighting device, comprising:
a shield element; and
at least a first light source,
the first light source within a space defined by portions of the shield element,
the shield element comprising at least a first shield member and at least a first vent through which gas can pass to exit from the space,
an entirety of the space to an emission side of an emission plane of the first light source.

26. A lighting device, comprising:
a shield element; and
at least a first light source,
the first light source within a space defined by portions of the shield element,
the shield element comprising at least a first vent through which gas can pass to exit from the space,
an emission plane of the first light source extending through the first light source,
an entirety of the space to an emission side of the emission plane.

27. A shield element, comprising:
shield element regions that define a space; and
at least a first vent through which gas can pass to exit from the space,
the shield element blocking at least a first location within the space from direct view from at least all locations outside the shield element that are to a first side of a first plane,
substantially all portions of the shield element translucent or transparent.

* * * * *